US011933041B2

(12) United States Patent
Okumura et al.

(10) Patent No.: US 11,933,041 B2
(45) **Date of Patent: *Mar. 19, 2024**

(54) SOUND-INSULATING STRUCTURE FOR BUILDING

(71) Applicant: SEKISUI HOUSE, LTD., Osaka (JP)

(72) Inventors: Miki Okumura, Osaka (JP); Hideo Nagamatsu, Osaka (JP)

(73) Assignee: SEKISUI HOUSE, LTD., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/792,955

(22) PCT Filed: Jan. 26, 2021

(86) PCT No.: PCT/JP2021/002548

§ 371 (c)(1),
(2) Date: Jul. 14, 2022

(87) PCT Pub. No.: WO2021/153534

PCT Pub. Date: Aug. 5, 2021

(65) Prior Publication Data

US 2023/0051426 A1 Feb. 16, 2023

(30) Foreign Application Priority Data

Jan. 29, 2020 (JP) ..... 2020-012617

(51) Int. Cl.
*E04B 1/86* (2006.01)
*E04B 1/82* (2006.01)
*E04B 2/56* (2006.01)

(52) U.S. Cl.
CPC ..... *E04B 1/86* (2013.01); *E04B 2/56* (2013.01); *E04B 2001/8254* (2013.01); *E04B 2001/8263* (2013.01)

(58) Field of Classification Search
CPC ..... E04B 1/86; E04B 2/56; E04B 2/58; E04B 2/7409; E04B 2/7457; E04B 2/76;
(Continued)

(56) References Cited

U.S. PATENT DOCUMENTS 2,268,485 A * 12/1941 Hurlbert, Jr. ..... E04B 2/58 52/290
3,309,825 A * 3/1967 Zinn ..... E04B 2/7457 52/349

(Continued)

FOREIGN PATENT DOCUMENTS

DE 20221261 U1 * 10/2005 ..... E04B 2/7411
DE 202009009095 U1 * 10/2009 ..... E04B 1/14

(Continued)

OTHER PUBLICATIONS

International Search Report for PCT/JP2021/002548 dated Apr. 20, 2021.

*Primary Examiner* — Theodore V Adamos
(74) *Attorney, Agent, or Firm* — Birch, Stewart, Kolasch & Birch, LLP

(57) ABSTRACT

A sound insulation structure for a building includes: a floor material; a ceiling material opposed to the floor material in a vertical direction with a space in a building interposed therebetween; a partition wall extending in the vertical direction and partitioning the space into a first space and a second space adjacent to each other in a horizontal direction; and at least one face material out of a floor-side sound insulation face material stuck to a portion of the floor material in a range of a thickness of the partition wall and having a coincidence frequency different from that of the floor material, and a ceiling-side sound insulation face material stuck to a portion of the ceiling material in the range
(Continued)

of the thickness of the partition wall and having a coincidence frequency different from that of the ceiling material.

10 Claims, 12 Drawing Sheets

(58) Field of Classification Search
CPC ..... E04B 2/7415; E04B 2001/8263; E04B 2001/8254
See application file for complete search history.

(56) References Cited

U.S. PATENT DOCUMENTS

| | | | | | |
|---|---|---|---|---|---|
| 3,324,615 | A * | 6/1967 | Zinn | E04B 2/7409 52/364 |
| 2015/0275510 | A1* | 10/2015 | Klein | E04B 2/7411 52/232 |
| 2015/0361659 | A1* | 12/2015 | Sessler | E04B 2/16 52/483.1 |
| 2016/0369500 | A1* | 12/2016 | Leye | E04B 2/7407 |

FOREIGN PATENT DOCUMENTS

| | | | | |
|---|---|---|---|---|
| DE | 102017118004 | A1 * | 2/2019 | |
| JP | 63-37710 | U | 3/1988 | |
| JP | 5-47123 | U | 6/1993 | |
| JP | 2002-194832 | A | 7/2002 | |
| JP | 2004-278294 | A | 10/2004 | |
| JP | 2005146712 | A * | 6/2005 | |
| JP | 2005350888 | A * | 12/2005 | |
| JP | 2007-107315 | A | 4/2007 | |
| JP | 2007107315 | A * | 4/2007 | |
| JP | 4881502 | B2 * | 2/2012 | |
| JP | 3222355 | U | 7/2019 | |
| JP | 2020026674 | A * | 2/2020 | |
| KR | 20060067067 | A * | 6/2006 | E04B 1/86 |
| KR | 20-0432623 | Y1 | 12/2006 | |
| WO | WO-0102660 | A1 * | 1/2001 | E04B 2/7409 |
| WO | WO-2019043405 | A1 * | 3/2019 | E04B 1/14 |
| WO | WO-2019172040 | A1 * | 9/2019 | E04B 1/86 |
| WO | WO-2020256016 | A1 * | 12/2020 | |
| WO | WO-2022043224 | A1 * | 3/2022 | |

* cited by examiner

SOUND-INSULATING STRUCTURE FOR BUILDING

TECHNICAL FIELD

The present invention relates to a sound insulation structure for a building.

BACKGROUND ART

Conventionally, as described in Patent Literature 1, various studies have been made on sound insulation measures for preventing sound leakage from one space to the other space out of two spaces partitioned from each other by partition walls in a building. Patent Literature 1 recites a sound insulation partition wall in which hollow studs are arranged in a zigzag manner in a cross section of a wall, and fireproof boards of different types are attached to each hollow stud in an overlapping manner. According to this partition wall, it is considered that resonance transmission can be suppressed and a decrease in a sound insulation value can be prevented by using different types of fireproof boards in an overlapping manner.

In Patent Literature 1, while improvement of sound insulation performance of partition walls has been studied, measures against sound leakage between chambers via floor materials and ceiling materials have not been taken into consideration. Therefore, sound generated in one of the two spaces partitioned by the partition wall can be propagated to the other space via the floor material or the ceiling material due to a coincidence effect, and thus there is a problem that a sound insulation effect becomes insufficient.

CITATION LIST

Patent Literature

Patent Literature 1: Japanese Unexamined Utility Model Publication No. SHO 63-37710

SUMMARY OF INVENTION

An object of the present invention is to provide a sound insulation structure for a building, the sound insulation structure enabling further improvement of sound insulation performance.

A sound insulation structure for a building according to one aspect of the present invention includes: a floor material; a ceiling material opposed to the floor material in a vertical direction with a space in a building interposed therebetween; a partition wall extending in the vertical direction and partitioning the space into a first space and a second space adjacent to each other in a horizontal direction; and at least one face material out of a floor-side sound insulation face material stuck to a portion of the floor material in a range of a thickness of the partition wall and having a coincidence frequency different from that of the floor material, and a ceiling-side sound insulation face material stuck to a portion of the ceiling material in the range of the thickness of the partition wall and having a coincidence frequency different from that of the ceiling material.

A sound insulation structure for a building according to another aspect of the present invention includes: a floor material; a ceiling material opposed to the floor material in a vertical direction with a space in a building interposed therebetween; a partition wall extending in the vertical direction, partitioning the space into a first space and a second space adjacent to each other in a horizontal direction, and having a first outer surface facing a first space side and a second outer surface facing a second space side; and at least one face material out of a first ceiling-side sound insulation face material having a coincidence frequency different from that of the ceiling material and stuck to at least a portion of the ceiling material between a position corresponding to the first outer surface and a position corresponding to a center of the first space in the horizontal direction, and a second ceiling-side sound insulation face material having a coincidence frequency different from that of the ceiling material and stuck to at least a portion of the ceiling material between a position corresponding to the second outer surface and a position corresponding to a center of the second space in the horizontal direction.

A sound insulation structure for a building according to still another aspect of the present invention includes: a floor material; a ceiling material opposed to the floor material in a vertical direction with a space in a building interposed therebetween; a partition wall extending in the vertical direction, partitioning the space into a first space and a second space adjacent to each other in a horizontal direction, and having a first outer surface facing a first space side and a second outer surface facing a second space side; an outer wall extending in a direction intersecting the partition wall; and at least one face material out of a first outer wall side sound insulation face material having a coincidence frequency different from that of the outer wall and stuck to at least a portion of the outer wall between a position corresponding to the first outer surface and a position corresponding to a center of the first space in the horizontal direction, and a second outer wall side sound insulation face material having a coincidence frequency different from that of the outer wall and stuck to at least a portion of the outer wall between a position corresponding to the second outer surface and a position corresponding to a center of the second space in the horizontal direction.

According to the present invention, it is possible to provide a sound insulation structure for a building, the sound insulation structure enabling further improvement of sound insulation performance.

DESCRIPTION OF EMBODIMENTS

In the following, sound insulation structures for a building according to embodiments of the present invention will be described in detail with reference to the drawings.

First Embodiment

Figure 1:
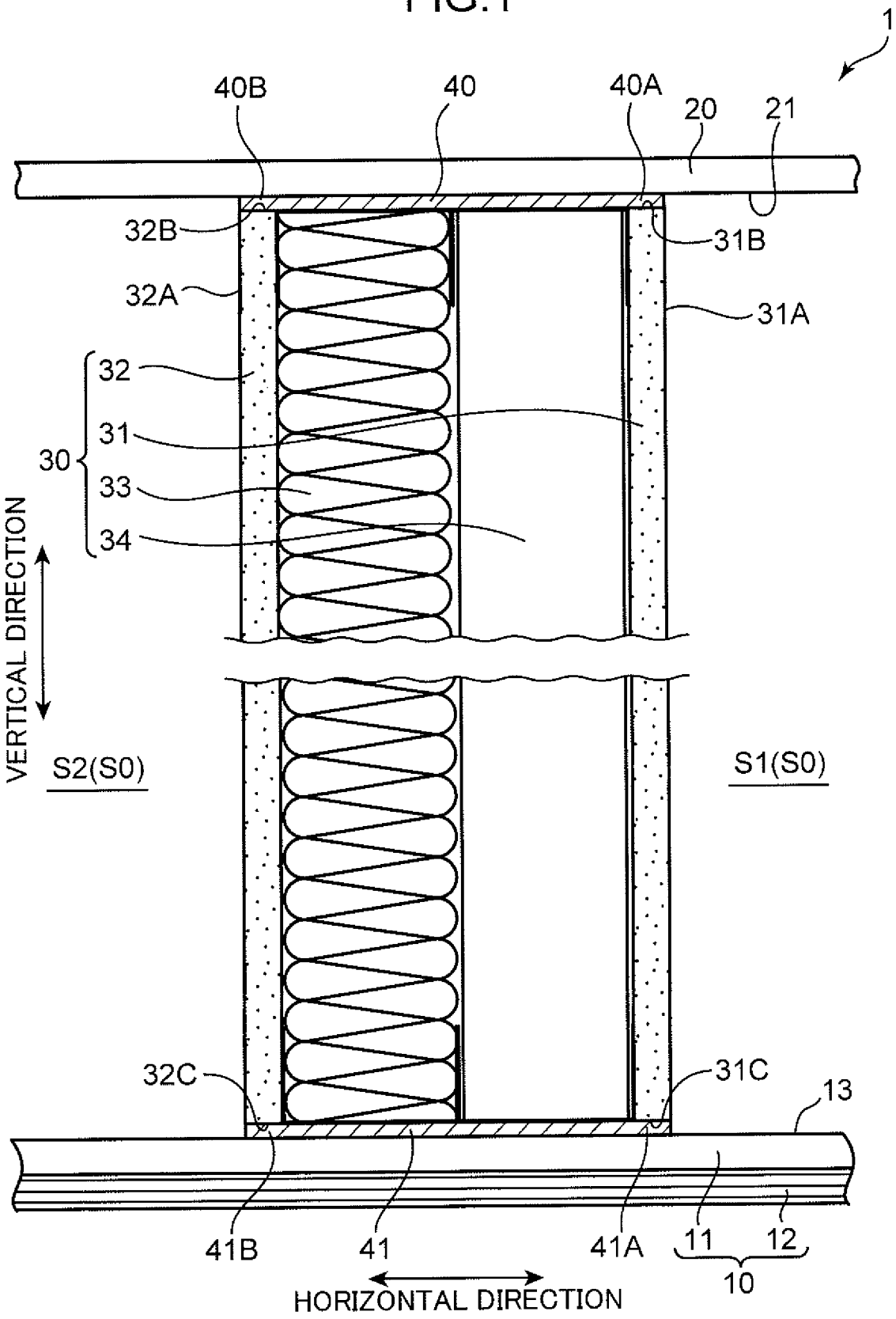
FIG. 1 is a vertical sectional view schematically illustrating a configuration of a sound insulation structure for a building according to a first embodiment of the present invention.
Figure 2:
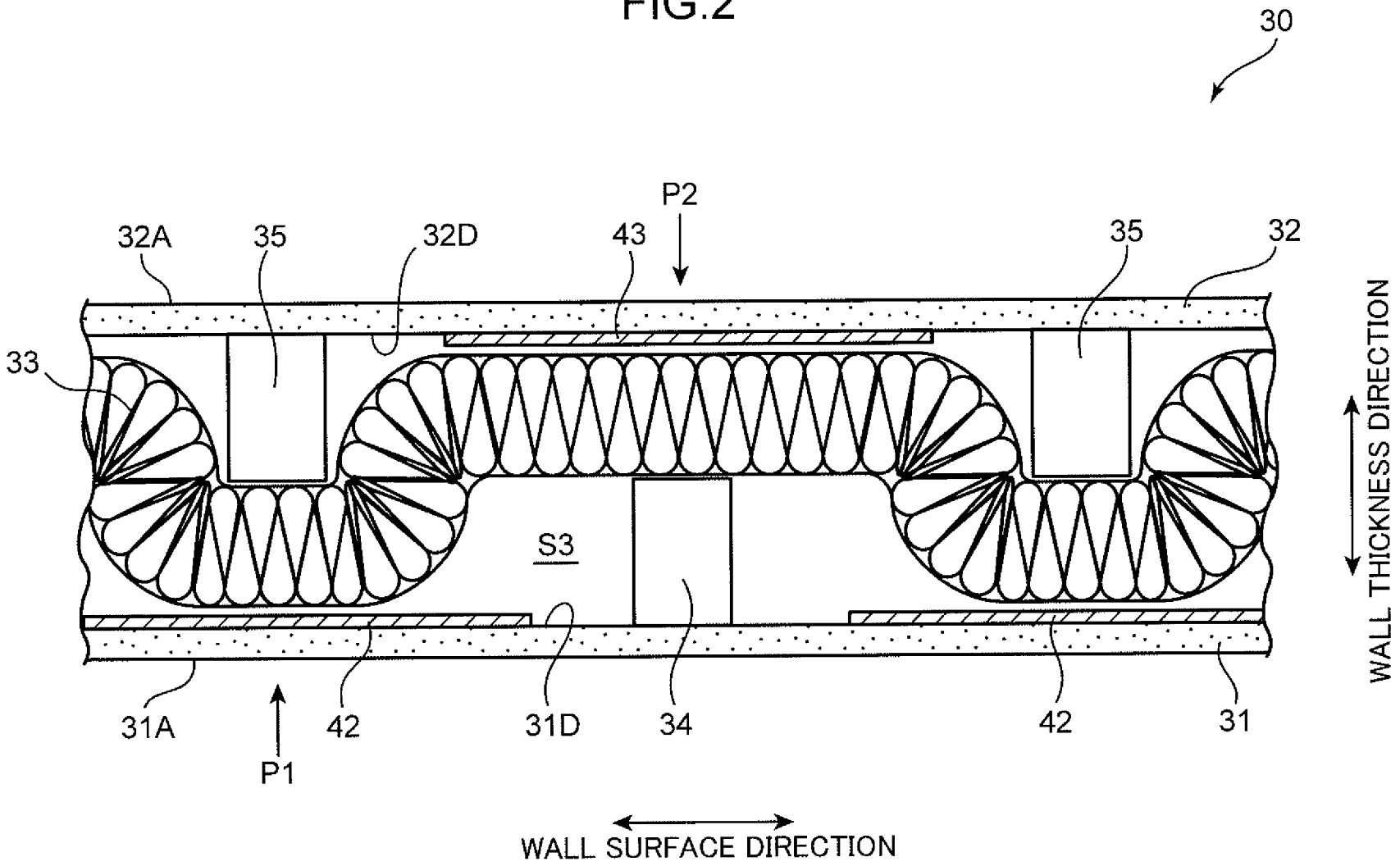
FIG. 2 is a horizontal sectional view schematically illustrating the configuration of the sound insulation structure for a building according to the first embodiment of the present invention.

First, a configuration of a sound insulation structure for a building 1 (hereinafter, also simply referred to as the "sound insulation structure 1") according to a first embodiment of the present invention will be described with reference to FIGS. 1 and 2. FIG. 1 schematically illustrates a section of a partition wall 30 taken along a vertical direction. FIG. 2 schematically illustrates a section of the partition wall 30 taken along a horizontal direction.

The sound insulation structure 1 is for suppressing sound leakage from one of two spaces (a first space S1 and a second space S2) partitioned by the partition wall 30 to the other space, for example, in a building such as a house. As illustrated in FIGS. 1 and 2, the sound insulation structure 1 mainly includes a floor material 10, a ceiling material 20, a partition wall 30, a ceiling-side sound insulation face material 40, a floor-side sound insulation face material 41, a first wall-side sound insulation face material 42, and a second wall-side sound insulation face material 43. These components will be described below.

The floor material 10 has a floor surface 13 facing a space S0 (e.g., a living space in a house) in the building. As illustrated in FIG. 1, the floor material 10 includes a plywood 12 laid horizontally and a flooring 11 laid on the plywood 12, and an upper surface of the flooring 11 is a floor surface 13.

The ceiling material 20 is opposed to the floor material 10 in a vertical direction with the space S0 interposed therebetween. The ceiling material 20 is made of, for example, a gypsum plasterboard, and has a ceiling lower surface 21 that is parallel to the floor surface 13 and faces the space S0 side.

The partition wall 30 extends in the vertical direction and partitions the space S0 into the first space S1 and the second space S2 adjacent to each other in the horizontal direction. Although as illustrated in FIG. 1, the floor material 10 and the ceiling material 20 according to the present embodiment each have a continuous structure from the first space S1 to the second space S2 with the partition wall 30 interposed therebetween without having formed a cut, a gap, or the like midway, the structure is not limited thereto.

As illustrated in FIGS. 1 and 2, the partition wall 30 mainly includes a first face material 31, a second face material 32 disposed with a hollow portion S3 between the first face material 31 and the second face material in the horizontal direction, a first vertical material 34 (first stud) fixed to the first face material 31, a second vertical material 35 (second stud) fixed to the second face material 32, and a sound absorbing material 33.

As illustrated in FIG. 1, the first face material 31 extends in the vertical direction. The first face material 31 is disposed perpendicular to the floor material 10 and the ceiling material 20, and has a first outer surface 31A facing the first space S1 side, a first upper end surface 31B facing the ceiling lower surface 21 side, a first lower end surface 31C facing the floor surface 13 side, and a first inner surface 31D (FIG. 2) facing the hollow portion S3 side.

The second face material 32 extends in the vertical direction similarly to the first face material 31. The second face material 32 is disposed in parallel with the first face material 31 and has a second outer surface 32A facing the second space S2 side, a second upper end surface 32B facing the ceiling lower surface 21 side, a second lower end surface 32C facing the floor surface 13 side, and a second inner surface 32D (FIG. 2) facing the hollow portion S3 side and opposed to the first inner surface 31D with the hollow portion S3 interposed therebetween. Although the first face material 31 and the second face material 32 in the present embodiment have a rectangular shape in a plan view, and are made of a gypsum plasterboard having the same thickness and the same coincidence frequency as the ceiling material 20, the face materials are not limited thereto.

The first vertical material 34 is a columnar material having a rectangular section extending in the vertical direction, and has one side surface thereof fixed to the first inner surface 31D (FIG. 2). The second vertical material 35 is a columnar material having a rectangular section extending in the vertical direction so as to be parallel to the first vertical material 34, and has one side surface thereof fixed to the second inner surface 32D.

As illustrated in FIG. 2, the first vertical materials 34 and the second vertical materials 35 in the present embodiment are arranged in a zigzag manner along a wall surface direction of the partition wall 30 (a direction orthogonal to a wall thickness direction of the partition wall 30). In other words, an arrangement is adopted in which positions of the first vertical materials 34 and the second vertical materials 35 arranged in order as viewed from the wall surface direction are alternately allocated to the first inner surface 31D and the second inner surface 32D.

The sound absorbing material 33 is a member for absorbing sound propagated from one of the first space S1 and the second space S2 to the partition wall 30, and is laid in the hollow portion S3 between the first face material 31 and the second face material 32. As illustrated in FIG. 2, the sound absorbing material 33 in the present embodiment is disposed so as to meander along a zigzag arrangement of the first vertical materials 34 and the second vertical materials 35.

Note that the sound absorbing material 33 is not an essential component in the present invention, and may be omitted.

The ceiling-side sound insulation face material 40 (FIG. 1) is stuck to a portion (the ceiling lower surface 21) of the ceiling material 20 in a range of a thickness of the partition wall 30, and has a coincidence frequency different from that of the ceiling material 20. Specifically, the ceiling-side sound insulation face material 40 is made of a gypsum plasterboard containing a glass fiber nonwoven fabric and having a constant thickness, and has the coincidence frequency different from that of the ceiling material 20 by 1/12 octave. The ceiling-side sound insulation face material 40 is stuck to the ceiling lower surface 21 with, for example, an adhesive or the like, and may be stuck to the ceiling lower surface 21 after the adhesive is applied to the entire surface, or may be stuck to the ceiling lower surface 21 after the adhesive is applied to a part of the surface.

As illustrated in FIG. 1, the ceiling-side sound insulation face material 40 in the present embodiment is stuck to the entire range of the ceiling material 20 (the ceiling lower surface 21) from the first face material 31 to the second face material 32. One end portion 40A of the ceiling-side sound insulation face material 40 in a width direction is sandwiched between the ceiling lower surface 21 and the first upper end surface 31B, while the other end portion 40B of the ceiling-side sound insulation face material 40 in the width direction is sandwiched between the ceiling lower surface 21 and the second upper end surface 32B. The one end portion 40A is substantially flush with the first outer surface 31A, and the other end portion 40B is substantially flush with the second outer surface 32A.

In addition, the ceiling-side sound insulation face material 40 in the present embodiment is stuck to a portion of the ceiling material 20, the portion being in the range of the thickness of the partition wall 30 and having a predetermined length in the wall surface direction of the partition wall 30. Specifically, the ceiling-side sound insulation face material 40 is stuck to the ceiling lower surface 21 over the entire area in the wall surface direction of the partition wall 30 (a direction orthogonal to a paper surface in FIG. 1). In other words, the ceiling-side sound insulation face material 40 is a board material having a short side corresponding to the thickness of the partition wall 30 and a long side corresponding to a width of the partition wall 30.

The floor-side sound insulation face material 41 is stuck to a portion of the floor material 10 in the range of the thickness of the partition wall 30 and has a coincidence frequency different from that of the floor material 10. Similarly to the ceiling-side sound insulation face material 40, the floor-side sound insulation face material 41 is made of a gypsum plasterboard containing a glass fiber nonwoven fabric and having a constant thickness, and has the coincidence frequency different from that of the floor material 10 by 1/12 octave. Similarly to the ceiling-side sound insulation face material 40, the floor-side sound insulation face material 41 is stuck to the floor surface 13 with, for example, an adhesive or the like.

The floor-side sound insulation face material 41 in the present embodiment is stuck to the entire range of the floor material 10 (floor surface 13) from the first face material 31 to the second face material 32. As illustrated in FIG. 1, one end portion 41A of the floor-side sound insulation face material 41 in the width direction is sandwiched between the first lower end surface 31C and the floor surface 13, while the other end portion 41B of the floor-side sound insulation face material 41 is sandwiched between the second lower end surface 32C and the floor surface 13. The one end portion 41A is substantially flush with the first outer surface 31A, and the other end portion 41B is substantially flush with the second outer surface 32A.

The floor-side sound insulation face material 41 in the present embodiment is stuck to a portion of the floor material 10, the portion being in the range of the thickness of the partition wall 30 and having a predetermined length in the wall surface direction of the partition wall 30. Specifically, the floor-side sound insulation face material 41 is stuck to the floor surface 13 over the entire area in the wall surface direction of the partition wall 30. Specifically, the floor-side sound insulation face material 41 has a short side corresponding to the thickness of the partition wall 30 and a long side corresponding to the width of the partition wall 30, and is a board material having substantially the same size and shape as the ceiling-side sound insulation face material 40.

As illustrated in FIG. 2, a plurality of the first wall-side sound insulation face materials 42 are stuck to a part of the first inner surface 31D so as to overlap the second vertical materials 35 in a front view of the first face material 31 (an arrow P1 in FIG. 2) and to be spaced apart from the first vertical materials 34 in the wall surface direction. More specifically, the first wall-side sound insulation face material 42 extends in the vertical direction, and is stuck to the first inner surface 31D in a state of having a gap formed in the wall surface direction from the first vertical material 34 and a gap formed in the wall thickness direction from the second vertical material 35. As illustrated in FIG. 2, the sound absorbing material 33 is laid in the gap between the first wall-side sound insulation face material 42 and the second vertical material 35. The first wall-side sound insulation face material 42 is stuck to the first inner surface 31D by, for example, an adhesive or the like, and the adhesive may be applied to the entire bonding surface, or the adhesive may be applied to a part of the bonding surface.

Although not illustrated in FIG. 2, the first wall-side sound insulation face material 42 is located between the two first vertical materials 34 adjacent to each other in the wall surface direction. Further, although the center of the first wall-side sound insulation face material 42 in the wall surface direction coincides with the center of the second vertical material 35 in the wall surface direction, the present invention is not limited thereto.

The first wall-side sound insulation face material 42 has a coincidence frequency different from that of the first face material 31. Specifically, the first wall-side sound insulation face material 42 is made of a gypsum plasterboard containing a glass fiber nonwoven fabric and having a constant thickness, and has the coincidence frequency different from that of the first face material 31 by 1/12 octave. Although the first wall-side sound insulation face material 42 in the present embodiment is made of a gypsum plasterboard thinner than the first face material 31, the material is not limited thereto.

A plurality of the second wall-side sound insulation face materials 43 are stuck to a part of the second inner surface 32D so as to overlap the first vertical materials 34 and to be spaced apart from the second vertical materials 35 in the wall surface direction in a front view of the second face material 32 (an arrow P2 in FIG. 2). Specifically, the second wall-side sound insulation face material 43 extends in the vertical direction, and is stuck to the second inner surface 32D in a state of having a gap formed in the wall surface direction from the second vertical material 35 and a gap formed from the first vertical material 34. The sound absorbing material 33 is laid in the gap between the second wall-side sound insulation face material 43 and the first vertical material 34. The second wall-side sound insulation face material 43 is stuck to the second inner surface 32D by, for example, an adhesive or the like, and the adhesive may be applied to the entire bonding surface, or the adhesive may be applied to a part of the bonding surface.

As illustrated in FIG. 2, the second wall-side sound insulation face material 43 is located between two second vertical materials 35 adjacent to each other in the wall surface direction. Although the center of the second wall-side sound insulation face material 43 in the wall surface direction coincides with the center of the first vertical material 34 in the wall surface direction, the present invention is not limited thereto.

The first wall-side sound insulation face material 42 and the second wall-side sound insulation face material 43 in the present embodiment are arranged in a zigzag manner along the wall surface direction of the partition wall 30. Specifically, the positions of the first wall-side sound insulation face material 42 and the second wall-side sound insulation face material 43 arranged in order as viewed from the wall surface direction are alternately allocated to the first inner surface 31D and the second inner surface 32D.

The second wall-side sound insulation face material 43 has a coincidence frequency different from that of the second face material 32. Specifically, similarly to the first wall-side sound insulation face material 42, the second wall-side sound insulation face material 43 is made of a gypsum plasterboard containing a glass fiber nonwoven fabric and having a constant thickness and has the coincidence frequency different from that of the second face material 32 by 1/12 octave. Although the second wall-side sound insulation face material 43 is made of a gypsum plasterboard thinner than the second face material 32, it is not limited thereto.

As described in the foregoing, in the sound insulation structure for a building 1 according to the present embodiment, the floor-side sound insulation face material 41 having the coincidence frequency different from that of the floor material 10 and the ceiling-side sound insulation face material 40 having the coincidence frequency different from that of the ceiling material 20 are stuck to the portions of the floor material 10 and the ceiling material 20 in the range of the thickness of the partition wall 30. Therefore, when sound generated in one of the first space S1 and the second space S2 partitioned by the partition wall 30 is about to propagate to the other space via the floor material 10 and the ceiling material 20 due to the coincidence effect, the coincidence effect of the portions of the floor material 10 and the ceiling material 20 in the range of the thickness of the partition wall 30 can be suppressed. As a result, sound leakage via the floor material 10 and the ceiling material 20 is suppressed to improve sound insulation performance.

Figure 3:
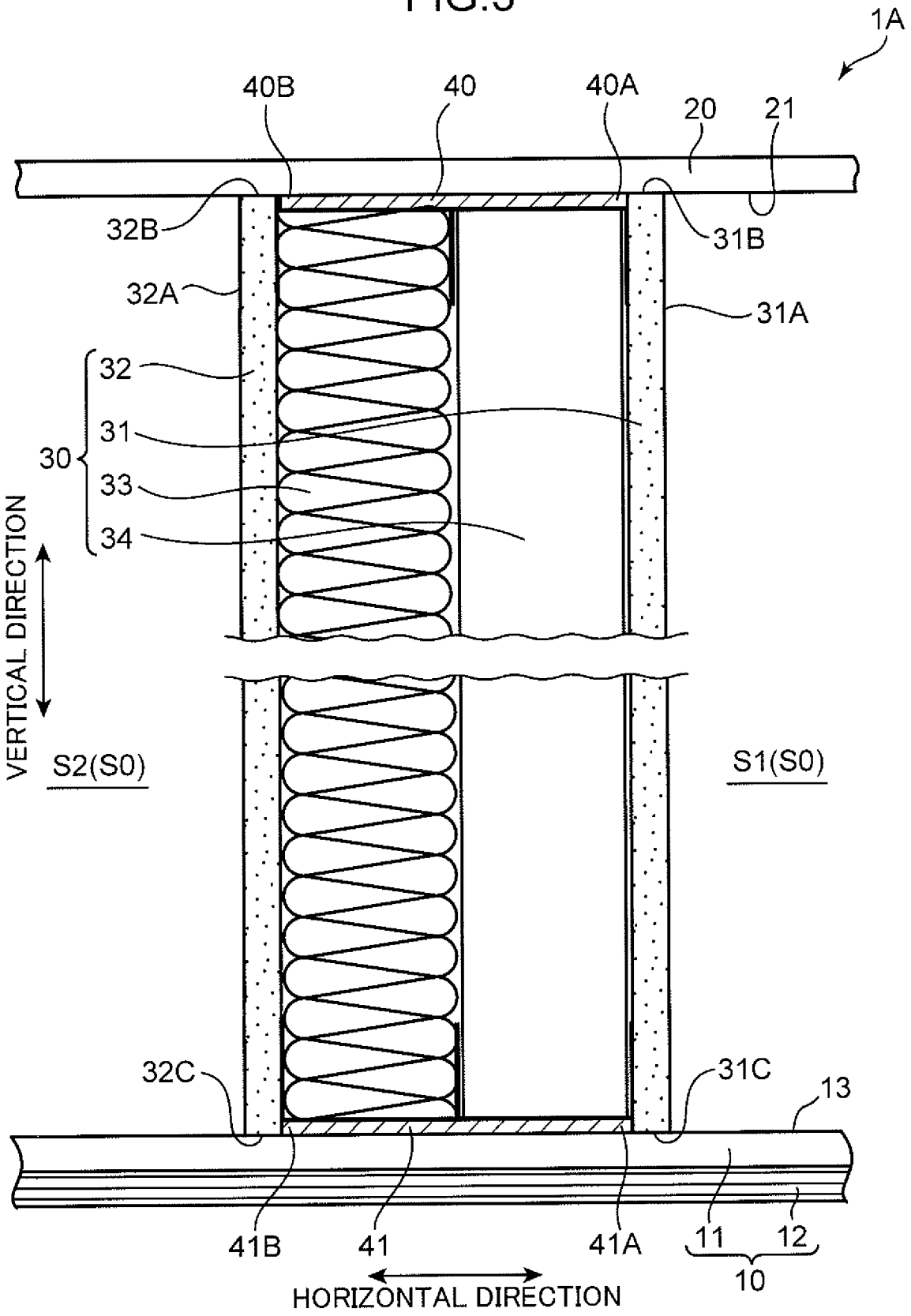
FIG. 3 is a vertical sectional view schematically illustrating a configuration of a sound insulation structure for a building according to a modification of the first embodiment of the present invention.

FIG. 3 is a vertical sectional view schematically illustrating a configuration of a sound insulation structure for a building 1A according to a modification of the first embodiment. Not exclusively being sandwiched between the ceiling lower surface 21 and an upper end surface of the partition wall 30, the ceiling-side sound insulation face material 40 may have a width that falls within a hollow portion of the partition wall 30 as illustrated in FIG. 3. Similarly, the floor-side sound insulation face material 41 may also have a width that falls within the hollow portion of the partition wall 30.

Second Embodiment

Figure 4:
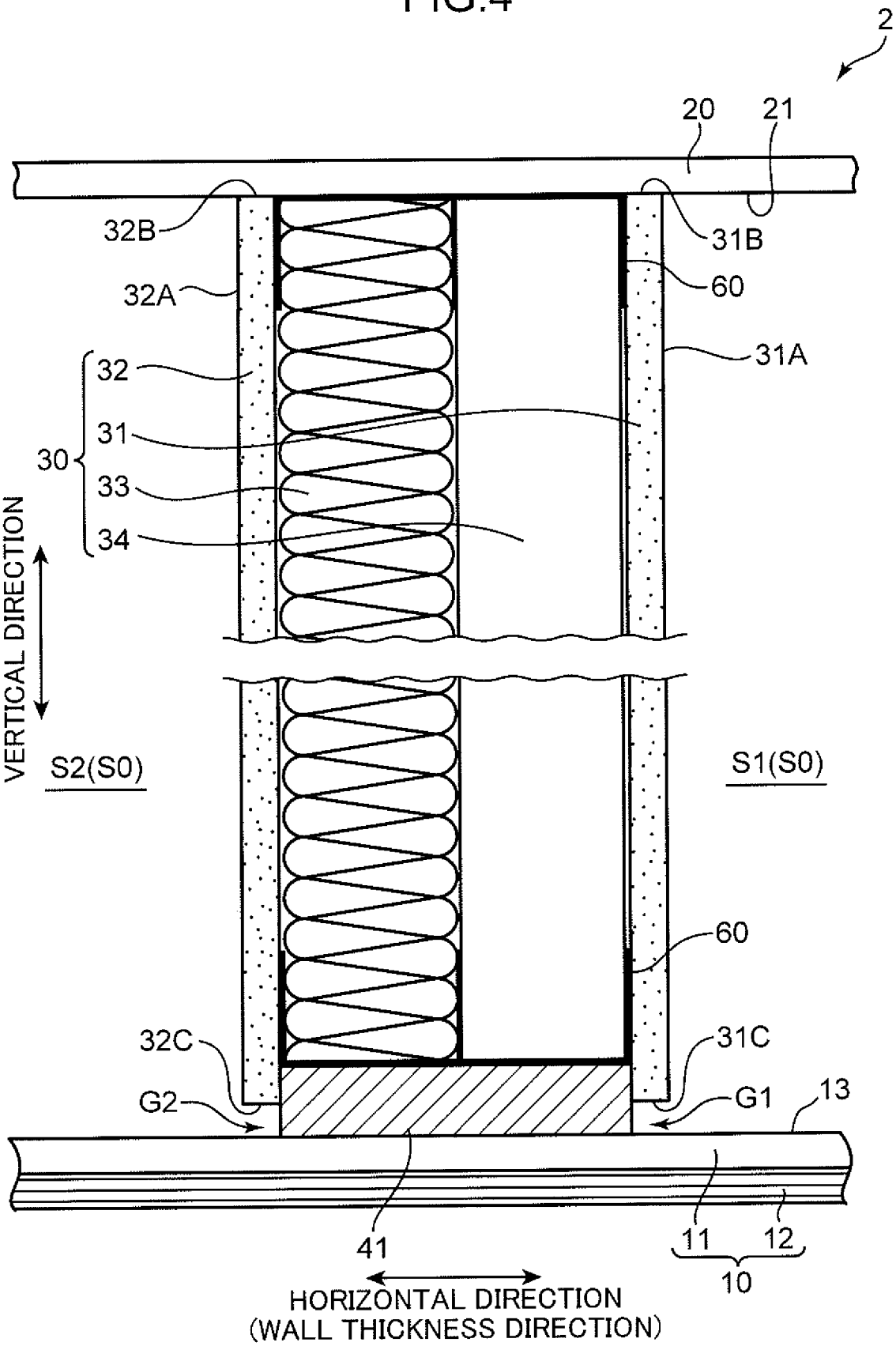
FIG. 4 is a vertical sectional view schematically illustrating a configuration of a sound insulation structure for a building according to a second embodiment of the present invention.

Next, a sound insulation structure for a building 2 (hereinafter, also simply referred to as the "sound insulation structure 2") according to a second embodiment of the present invention will be described with reference to FIGS. 4 and 5. Although the sound insulation structure 2 according to the second embodiment basically has the same configuration and exhibits the same effects as those of the sound insulation structure 1 according to the first embodiment, it is different from the first embodiment in that the floor-side sound insulation face material 41 is formed to be thicker. In the following, only differences from the first embodiment will be described.

A height dimension of the first face material 31 (a distance between the first upper end surface 31B and the first lower end surface 31C) is smaller than a distance between the floor surface 13 and the ceiling lower surface 21. As illustrated in FIG. 4, the first face material 31 is disposed such that the first upper end surface 31B abuts on the ceiling lower surface 21 and a gap (a first lower gap G1) is formed in the vertical direction between the first lower end surface 31C and the floor surface 13.

Similarly to the first face material 31, a height dimension of the second face material 32 (a distance between the second upper end surface 32B and the second lower end surface 32C) is smaller than the distance between the floor surface 13 and the ceiling lower surface 21. The second face material 32 is disposed such that the second upper end surface 32B abuts on the ceiling lower surface 21 and a gap (a second lower gap G2) is formed between the second lower end surface 32C and the floor surface 13.

The sound insulation structure 2 includes a positioning member 60 (runner) that positions the first vertical material 34 and the second vertical material 35 (FIG. 2) in the horizontal direction (the wall thickness direction of the partition wall 30). As illustrated in FIG. 4, the positioning member 60 is placed on the floor-side sound insulation face material 41 and is fixed to the floor surface 13 with a fixing tool such as a screw.

Figure 5:
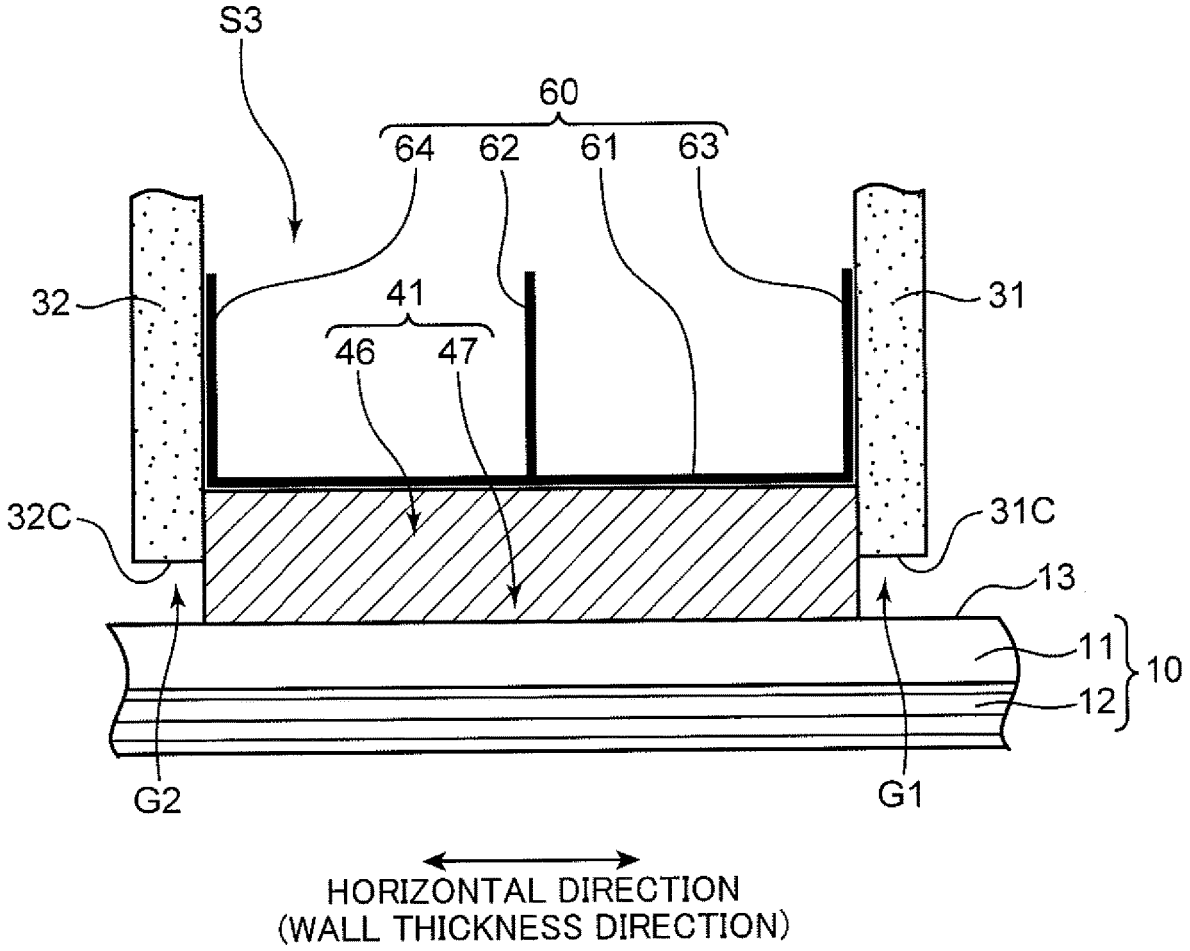
FIG. 5 is an enlarged view of the vicinity of a floor-side sound insulation face material of the sound insulation structure for a building according to the second embodiment of the present invention.

FIG. 5 is an enlarged view of the vicinity of the floor-side sound insulation face material 41. The floor-side sound insulation face material 41 is a member that is thicker than the first lower gap G1 and the second lower gap G2, is disposed on the floor surface 13 so as to block the first lower gap G1 and the second lower gap G2 from the hollow portion S3 side, and includes a portion having a surface density ($kg/m^2$) higher than that of the positioning member 60. Specifically, the floor-side sound insulation face material 41 includes a first face material portion 47 having the same thickness as the first lower gap G1 and the second lower gap G2, and a second face material portion 46 overlapping lower portions of the first face material 31 and the second face material 32 in the horizontal direction (the wall thickness direction of the partition wall 30). The second face material portion 46 is a portion of the floor-side sound insulation face material 41 above the first lower end surface 31C and the second lower end surface 32C, and both side surfaces of the first face material portion 47 in a width direction block the first lower gap G1 and the second lower gap G2 from the hollow portion S3 side.

The second face material portion 46 has a surface density higher than the surface density of the positioning member 60. The surface density of the second face material portion 46 is preferably equal to or higher than a surface density of the first face material 31 and a surface density of the second face material 32, and further, preferably equal to or higher than a surface density of the floor material 10. Meanwhile, a surface density of the first face material portion 47 is not particularly limited, and may be lower than the surface density of the second face material portion 46 or may be the same as the surface density of the second face material portion 46.

Although the floor-side sound insulation face material 41 in the present embodiment is, for example, a material in which iron powder solidified with asphalt is sandwiched between nonwoven fabrics (asphalt-based damping material), the material is not limited thereto. In addition, the floor-side sound insulation face material 41 in the present embodiment has the coincidence frequency different from that of the floor material 10 similarly to the first embodiment, and the coincidence frequency of the floor-side sound insulation face material 41 is preferably different from that of the floor material 10 by 1/12 octave.

As illustrated in FIG. 5, the positioning member 60 includes a flat base portion 61 placed on the floor-side sound insulation face material 41 (the second face material portion 46), a central erect portion 62 vertically rising from the base portion 61, a first end side erect portion 63, and a second end side erect portion 64. The central erect portion 62 is erected perpendicularly to the base portion 61 from a central portion in a width direction of the base portion 61. The first end side erect portion 63 and the second end side erect portion 64 are erected perpendicularly to the base portion 61 from both ends in the width direction of the base portion 61. A lower portion of the first vertical material 34 (FIG. 2) is inserted into a groove between the central erect portion 62 and the first end side erect portion 63, and a lower end portion of the second vertical material 35 (FIG. 2) is inserted into a groove between the central erect portion 62 and the second end side erect portion 64. As illustrated in FIG. 4, the positioning member 60 is also fixed to the ceiling lower surface 21, and upper end portions of the first vertical material 34 and the second vertical material 35 are inserted into the grooves of the positioning member 60.

The positioning member 60 is not limited to a single plate member in which two grooves are formed. For example, two plate members formed in a U-shape in a sectional view may be placed side by side on the floor-side sound insulation face material 41.

According to the sound insulation structure 2 of the second embodiment, by blocking the gaps between the first face material 31 and the second face material 32 and the floor surface 13 by both side surfaces of the floor-side sound insulation face material 41, sound leakage to a neighboring chamber through the gaps can be suppressed. Moreover, since a surface density of the floor-side sound insulation face material 41 (the second face material portion 46) is higher than the surface density of the positioning member 60, the sound insulation performance can be further improved as compared with a case where the positioning member 60 is directly placed on the floor surface 13 to block the gaps. Note that the floor-side sound insulation face material 41 is not limited to one made from an asphalt-based damping material, and may be made of a gypsum plasterboard having a surface density higher than that of the positioning member 60.

Third Embodiment

Next, a sound insulation structure for a building 3 (hereinafter, also simply referred to as the "sound insulation structure 3") according to a third embodiment of the present invention will be described with reference to FIG. 6. While the sound insulation structure 3 according to the third embodiment basically has the same configuration and exhibits the same effects as those of the sound insulation structure 2 according to the second embodiment, it is different in that a gap is formed between the upper end surface of the partition wall 30 and the ceiling lower surface 21, and the gap is blocked by the ceiling-side sound insulation face material 40. In the following, only differences from the second embodiment will be described.

Figure 6:
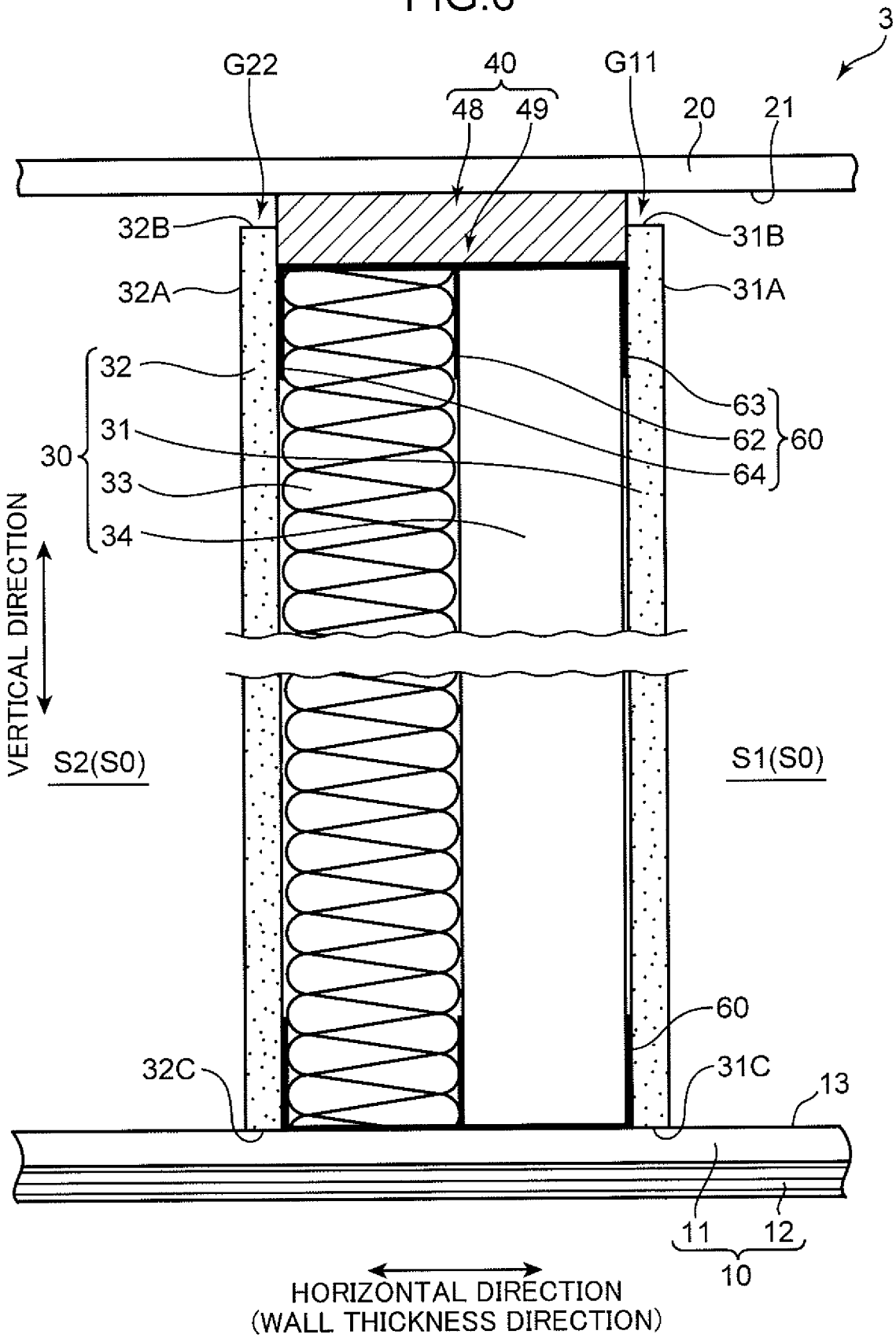
FIG. 6 is a vertical sectional view schematically illustrating a configuration of a sound insulation structure for a building according to a third embodiment of the present invention.

As illustrated in FIG. 6, the first face material 31 is disposed such that the first lower end surface 31C abuts on the floor surface 13 and a gap (a first upper gap G11) is formed between the first upper end surface 31B and the ceiling lower surface 21. Similarly, the second face material 32 is disposed such that the second lower end surface 32C abuts on the floor surface 13 and a gap (a second upper gap G22) is formed between the second upper end surface 32B and the ceiling lower surface 21.

The ceiling-side sound insulation face material 40 is thicker than the first upper gap G11 and the second upper gap G22, is disposed on the ceiling lower surface 21 so as to block the first upper gap G11 and the second upper gap G22 from the hollow portion S3 side, and includes a portion having a surface density higher than that of the positioning member 60. Specifically, the ceiling-side sound insulation face material 40 includes a first face material portion 48 having the same thickness as the first upper gap G11 and the second upper gap G22, and a second face material portion 49 overlapping upper portions of the first face material 31 and the second face material 32 in the horizontal direction (the wall thickness direction of the partition wall 30). The second face material portion 49 is a portion of the ceiling-side sound insulation face material 40 below the first upper end surface 31B and the second upper end surface 32B, and both side surfaces of the first face material portion 48 in a width direction block the first upper gap G11 and the second upper gap G22 from the hollow portion S3 side.

The second face material portion 49 has a surface density higher than the surface density of the positioning member 60. The surface density of the second face material portion 49 is preferably equal to or higher than the surface density of the first face material 31 and the surface density of the second face material 32, and further, preferably equal to or higher than a surface density of the ceiling material 20. On the other hand, a surface density of the first face material portion 48 is not particularly limited, and may be lower than the surface density of the second face material portion 49 or may be the same as the surface density of the second face material portion 49.

Although the ceiling-side sound insulation face material 40 in the present embodiment is, for example, a material (asphalt-based damping material) in which iron powder solidified with asphalt is sandwiched between nonwoven fabrics, the material is not limited thereto. In addition, the ceiling-side sound insulation face material 40 in the present embodiment has the coincidence frequency different from that of the ceiling material 20 similarly to the first embodiment, and it is preferable that the coincidence frequency of the ceiling material 20 and the coincidence frequency of the ceiling-side sound insulation face material 40 are different from each other by 1/12 octave.

As illustrated in FIG. 6, the positioning member 60 is disposed below the ceiling-side sound insulation face material 40, and is fixed to the ceiling lower surface 21 together with the ceiling-side sound insulation face material 40 by a fixing tool such as a screw. The upper end portion of the first vertical material 34 (FIG. 2) is inserted into a groove between the central erect portion 62 and the first end side erect portion 63, and the upper end portion of the second vertical material 35 (FIG. 2) is inserted into a groove between the central erect portion 62 and the second end side erect portion 64. The positioning member 60 is directly fixed to the floor surface 13 with a fixing tool such as a screw.

According to the sound insulation structure 3 of the third embodiment, by blocking the gap between the first face material 31 and the second face material 32 and the ceiling lower surface 21 by both side surfaces of the ceiling-side sound insulation face material 40, it is possible to suppress sound leakage to a neighboring chamber through the gap. Moreover, since the ceiling-side sound insulation face material 40 includes the second face material portion 49 having the surface density higher than that of the positioning member 60, the sound insulation performance can be further improved as compared with the case where the positioning member 60 is directly fixed to the ceiling lower surface 21 to block the gap.

Note that the ceiling-side sound insulation face material 40 is not limited to one made from an asphalt-based damping material, and may be made of a gypsum plasterboard having a surface density higher than that of the positioning member 60. The ceiling-side sound insulation face material 40 in the third embodiment may be used in combination with the floor-side sound insulation face material 41 in the second embodiment.

Fourth Embodiment

Next, a sound insulation structure for a building 4 (hereinafter, also simply referred to as the "sound insulation structure 4") according to a fourth embodiment of the present invention will be described with reference to FIG. 7. The sound insulation structure 4 according to the fourth embodiment further includes a first ceiling-side sound insulation face material 45 and a second ceiling-side sound insulation face material 44 in addition to the floor material 10 (not illustrated in FIG. 7), the ceiling material 20, and the partition wall 30 described in the first embodiment. In the following, differences from the first embodiment will be described below. Note that components corresponding to the components described in the first embodiment are denoted by the same reference numerals, and the description thereof will be omitted.

Figure 7:
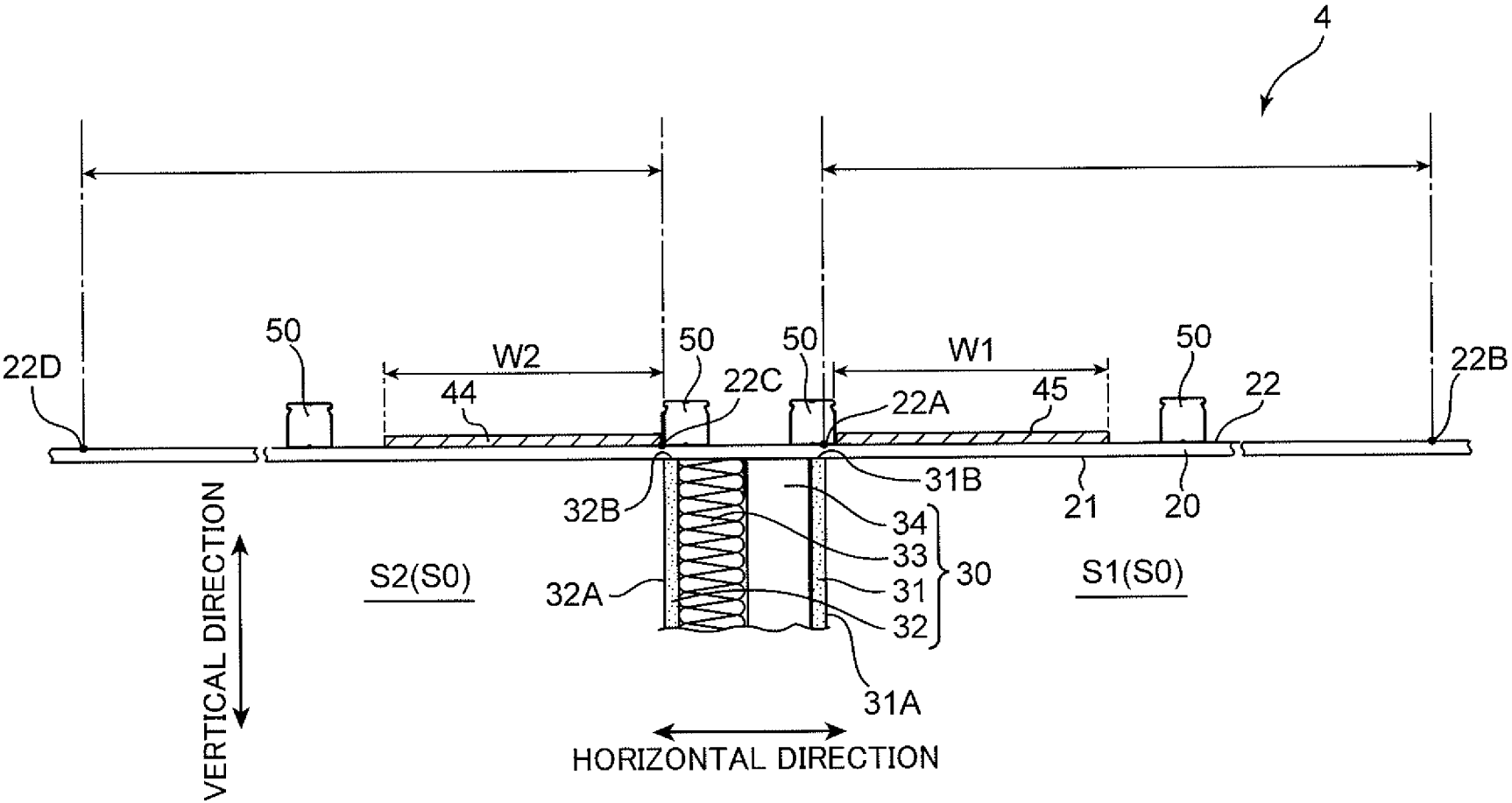
FIG. 7 is a vertical sectional view schematically illustrating a configuration of a sound insulation structure for a building according to a fourth embodiment of the present invention.

As illustrated in FIG. 7, the ceiling material 20 has a ceiling upper surface 22 facing the side (the side of a space above a ceiling) opposite to the ceiling lower surface 21, and a plurality of cradlings 50 are disposed on the ceiling upper surface 22. In the present embodiment, each of the cradlings 50 is disposed such that a length direction thereof faces the wall surface direction of the partition wall 30 (a direction orthogonal to the paper surface in FIG. 7).

The plurality of cradlings 50 are disposed at intervals (at equal intervals) in the horizontal direction (the direction orthogonal to the length direction of the cradling 50) on the ceiling upper surface 22. As illustrated in FIG. 7, the cradlings 50 are disposed in portions of the ceiling upper surface 22 located above the first face material 31 and the second face material 32. In other words, the cradlings 50 are disposed at positions, on the ceiling upper surface 22, overlapping the first face material 31 and the second face material 32 in the vertical direction.

The first ceiling-side sound insulation face material 45 is stuck to at least a portion of the ceiling material 20 between a position 22A corresponding to the first outer surface 31A and a position 22B corresponding to the center of the first space S1 in the horizontal direction (the wall thickness direction). More specifically, as illustrated in FIG. 7, the first ceiling-side sound insulation face material 45 is stuck to the ceiling upper surface 22 in a space between one cradling 50 overlapping the first face material 31 in the vertical direction and another cradling 50 adjacent, on the first space S1 side, to the one cradling 50. The "position corresponding to the first outer surface 31A" represents a position of the ceiling material 20 overlapping the first outer surface 31A in the vertical direction.

As illustrated in FIG. 7, the first ceiling-side sound insulation face material 45 in the present embodiment is stuck to the ceiling upper surface 22 in a part of the space between the one cradling 50 and the other cradling 50. In other words, a width W1 of the first ceiling-side sound insulation face material 45 is smaller than a distance between the one cradling 50 and the other cradling 50.

In the first ceiling-side sound insulation face material 45, an end portion on the partition wall 30 side is in contact with a side surface of the one cradling 50 (a side surface opposed to the other cradling 50). In other words, the center of the first ceiling-side sound insulation face material 45 in a width direction is located closer to the partition wall 30 (the first outer surface 31A) side than to the center between the one cradling 50 and the other cradling 50.

The first ceiling-side sound insulation face material 45 has a coincidence frequency different from that of the ceiling material 20. Specifically, the first ceiling-side sound insulation face material 45 is made of a gypsum plasterboard containing the same glass fiber nonwoven fabric as the first wall-side sound insulation face material 42 and the second wall-side sound insulation face material 43 described in the first embodiment, and has the coincidence frequency different from that of the ceiling material 20 by 1/12 octave.

The second ceiling-side sound insulation face material 44 is stuck to at least a portion of the ceiling material 20 between a position 22C corresponding to the second outer surface 32A and a position 22D corresponding to the center of the second space S2 in the horizontal direction (the wall thickness direction). Specifically, as illustrated in FIG. 7, the second ceiling-side sound insulation face material 44 is stuck to the ceiling upper surface 22 in a space between one cradling 50 overlapping the second face material 32 in the vertical direction and another cradling 50 adjacent, on the second space S2 side, to the one cradling 50. The "position corresponding to the second outer surface 32A" represents a position of the ceiling material 20 overlapping the second outer surface 32A in the vertical direction.

In a part of a space between the one cradling 50 and the other cradling 50, the second ceiling-side sound insulation face material 44 is stuck to the ceiling upper surface 22. In other words, a width W2 of the second ceiling-side sound insulation face material 44 is smaller than the distance between the cradlings. In the second ceiling-side sound insulation face material 44, an end portion on the partition wall 30 side is in contact with the side surface of the one cradling 50 (the side surface opposed to the other cradling 50). In other words, the center of the second ceiling-side sound insulation face material 44 in a width direction is located closer to the partition wall 30 (the second outer surface 32A) side than to the center between the one cradling 50 and the other cradling 50.

The second ceiling-side sound insulation face material 44 has a coincidence frequency different from that of the ceiling material 20. Specifically, the second ceiling-side sound insulation face material 44 is made of a gypsum plasterboard containing the same glass fiber nonwoven fabric as the first wall-side sound insulation face material 42 and the second wall-side sound insulation face material 43 described in the first embodiment, and has the coincidence frequency different from that of the ceiling material 20 by 1/12 octave. Accordingly, members can be shared among the first wall-side sound insulation face material 42, the second wall-side sound insulation face material 43, the first ceiling-side sound insulation face material 45, and the second ceiling-side sound insulation face material 44.

As described in the foregoing, in the sound insulation structure 4 according to the fourth embodiment, the face material having the coincidence frequency different from that of the ceiling material 20 is stuck to the portion of the ceiling material 20 between the position corresponding to the outer surface of the partition wall 30 and the position corresponding to the horizontal center of the space. Therefore, when sound generated in one of the first space S1 and the second space S2 partitioned by the partition wall 30 is about to propagate to the other space via the ceiling material 20 due to the coincidence effect, the coincidence effect of the ceiling material 20 can be suppressed. Accordingly, sound leakage via the ceiling material 20 is suppressed to improve sound insulation performance.

Fifth Embodiment

Next, a sound insulation structure for a building 5 (hereinafter, also simply referred to as the "sound insulation structure 5") according to a fifth embodiment of the present invention will be described with reference to FIGS. 8 to 10. Although the sound insulation structure 5 according to the fifth embodiment basically has the same configuration as the sound insulation structure 4 according to the fourth embodiment, it is different in including a first outer wall side sound insulation face material 73 and a second outer wall side sound insulation face material 74 instead of the first ceiling-side sound insulation face material 45 and the second ceiling-side sound insulation face material 44. In the following, only differences from the fourth embodiment will be described.

Figure 8:
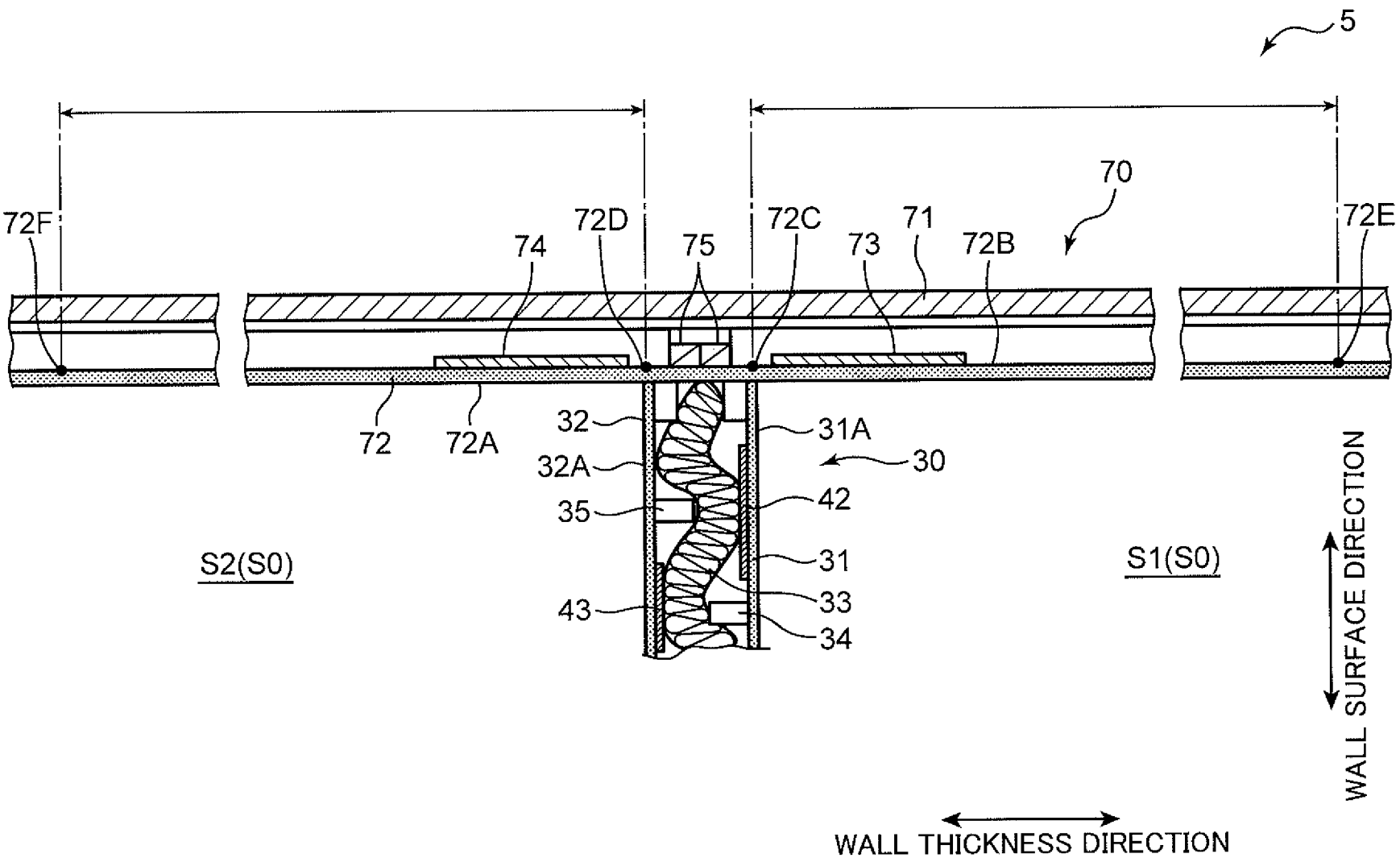
FIG. 8 is a horizontal sectional view schematically illustrating a configuration of a sound insulation structure for a building according to a fifth embodiment of the present invention.

FIG. 8 is a horizontal sectional view of an abutment portion (joint portion) between the partition wall 30 and an outer wall 70. The sound insulation structure 5 includes the outer wall 70 extending in a direction intersecting (orthogonal to) the partition wall 30. As illustrated in FIG. 8, one end portion of the partition wall 30 in the wall surface direction abuts on an inner surface of the outer wall 70.

The outer wall 70 includes an outer wall panel 71, an outer wall face material 72 disposed with a hollow portion interposed between the outer wall panel 71 and the outer wall face material, and a vertical bar 75 extending in the vertical direction in the hollow portion. The outer wall face material 72 is made of, for example, a gypsum plasterboard, and includes an inner surface 72A facing the space S0 side in the building and a back surface 72B facing the side (the hollow portion side) opposite to the inner surface 72A. The sound insulation structure 5 includes the first outer wall side sound insulation face material 73 and the second outer wall side sound insulation face material 74 stuck to the back surface 72B of the outer wall face material 72.

The first outer wall side sound insulation face material 73 is stuck to at least a portion of the back surface 72B of the outer wall face material 72, the portion being between a position 72C corresponding to the first outer surface 31A and a position 72E corresponding to the center of the first space S1 in the horizontal direction. Here, the "position corresponding to the first outer surface 31A" represents a position through which an extension line of the first outer surface 31A passes on the back surface 72B of the outer wall face material 72. The first outer wall side sound insulation face material 73 is made of a gypsum plasterboard having a coincidence frequency different from that of the outer wall face material 72, specifically, the coincidence frequency different from that of the outer wall face material 72 by 1/12 octave.

The second outer wall side sound insulation face material 74 is stuck to at least a portion of the back surface 72B of the outer wall face material 72, the portion being between a position 72D corresponding to the second outer surface 32A and a position 72F corresponding to the center of the second space S2 in the horizontal direction. Here, the "position corresponding to the second outer surface 32A" represents a position through which an extension line of the second outer surface 32A passes on the back surface 72B of the outer wall face material 72. The second outer wall side sound insulation face material 74 has a coincidence frequency different from that of the outer wall face material 72, specifically, the coincidence frequency different from that of the outer wall face material 72 by 1/12 octave.

Figure 9:
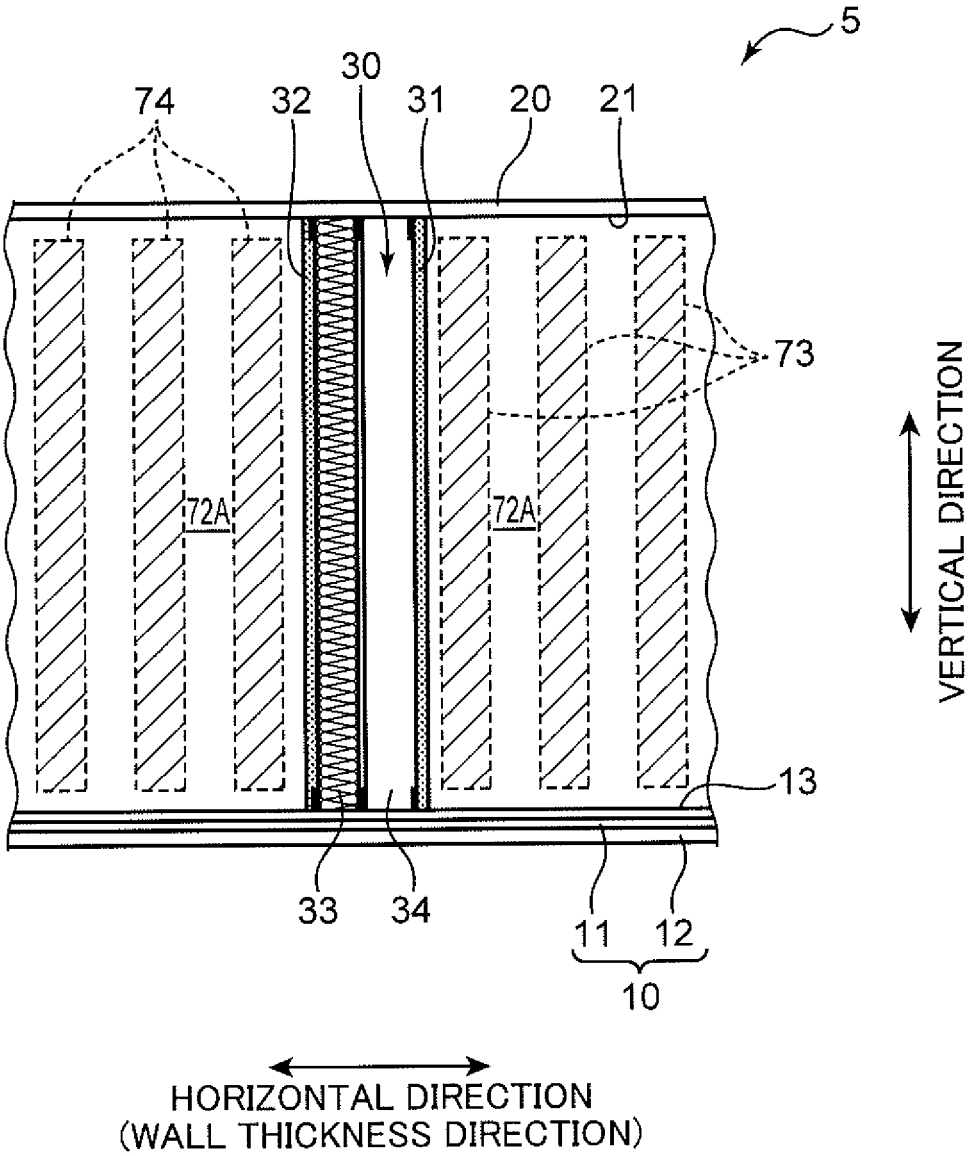
FIG. 9 is a vertical sectional view schematically illustrating the configuration of the sound insulation structure for a building according to the fifth embodiment of the present invention.
Figure 10:
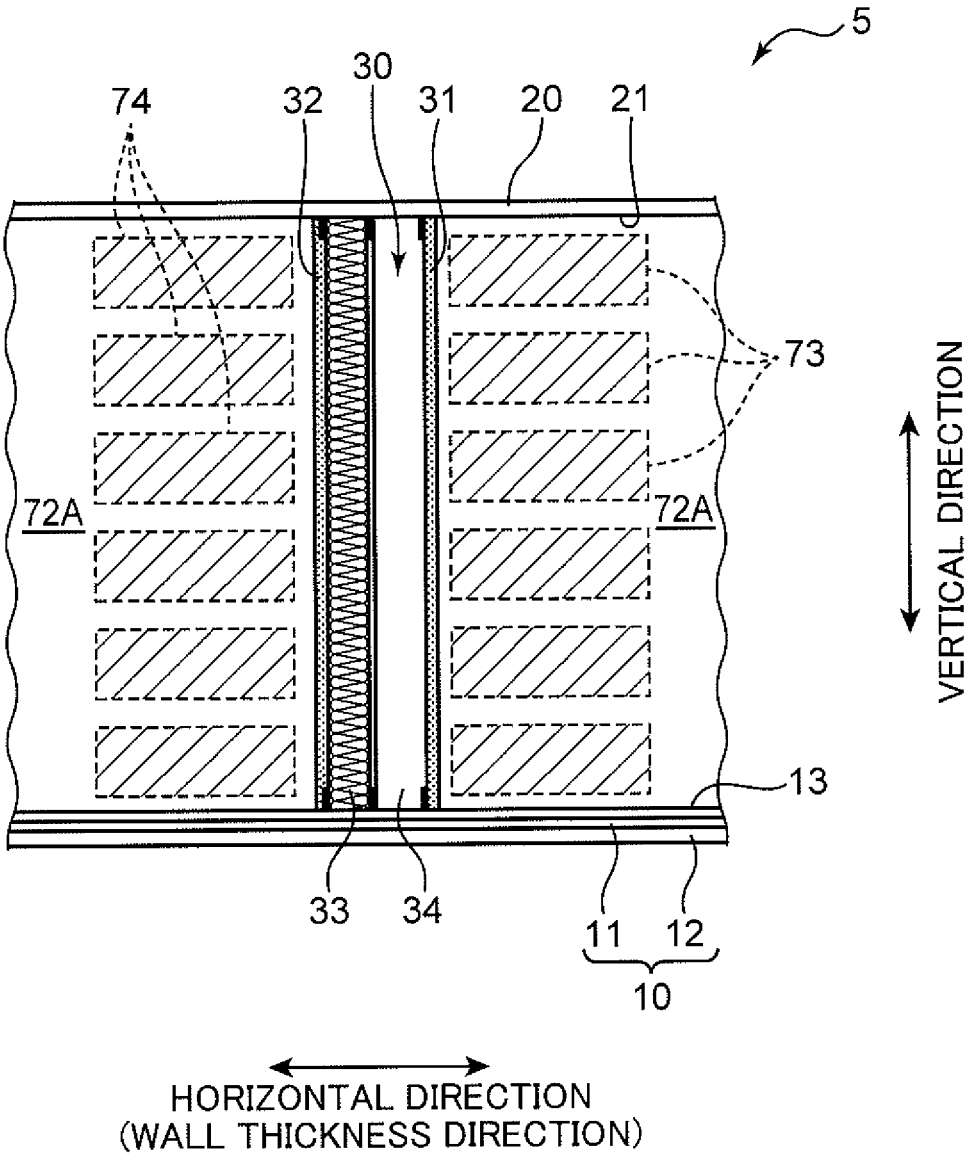
FIG. 10 is a vertical sectional view schematically illustrating a configuration of a sound insulation structure for a building according to a modification of the fifth embodiment of the present invention.

FIG. 9 is a partial sectional view of the sound insulation structure 5 when the inner surface 72A of the outer wall face material 72 is viewed from the front. As illustrated in FIG. 9, the first outer wall side sound insulation face material 73 has a rectangular shape elongated in the vertical direction, and a plurality of the first outer wall side sound insulation face materials are disposed at intervals in the horizontal direction (the wall thickness direction of the partition wall 30). Similarly, the second outer wall side sound insulation face material 74 also has a rectangular shape elongated in the vertical direction, and the second outer wall side sound insulation face materials are disposed at intervals in the horizontal direction.

In the sound insulation structure 5 according to the fifth embodiment, the additional face material having the coincidence frequency different from that of the outer wall face material 72 is stuck to the portion of the outer wall face material 72 between the position corresponding to the outer surface of the partition wall 30 and the position corresponding to the center of the space S0 in the horizontal direction. Therefore, when sound generated in one of the first space S1 and the second space S2 is about to propagate to the other space via the outer wall 70 due to the coincidence effect, the coincidence effect of the outer wall face material 72 can be suppressed. Accordingly, sound leakage to an adjacent space via the outer wall 70 is suppressed to improve sound insulation performance.

End portions of the first outer wall side sound insulation face material 73 and the second outer wall side sound insulation face material 74 on the partition wall 30 side may further extend to a position overlapping the partition wall 30 in the wall surface direction. In addition, as shown in FIG. 10, the first outer wall side sound insulation face material 73 and the second outer wall side sound insulation face material 74 may have a rectangular shape elongated in the horizontal direction (the wall thickness direction of the partition wall 30), and may be disposed in plurality at intervals in the vertical direction. In addition, the first outer wall side sound insulation face material 73 and the second outer wall side sound insulation face material 74 in the fifth embodiment may be used in combination with the first ceiling-side sound insulation face material 45 and the second ceiling-side sound insulation face material 44 in the fourth embodiment.

OTHER EMBODIMENTS

Here, other embodiments of the present invention will be described.

Although the first embodiment has been described with respect to the case, as an example, where both the ceiling-side sound insulation face material 40 and the floor-side sound insulation face material 41 are provided, one of the ceiling-side sound insulation face material 40 and the floor-side sound insulation face material 41 may be omitted.

Although the first embodiment has been described with respect to the case where the ceiling-side sound insulation face material 40 is stuck to the entire portion of the ceiling lower surface 21 in the range of the thickness of the partition wall 30, the ceiling-side sound insulation face material 40 may be stuck to only a part of the portion. Similarly, the floor-side sound insulation face material 41 may be stuck only to a part of the floor surface 13 in the range of the thickness of the partition wall 30.

Although the first embodiment has been described with respect to the case, as an example, where both the first wall-side sound insulation face material 42 and the second wall-side sound insulation face material 43 are provided, one of the first wall-side sound insulation face material 42 and the second wall-side sound insulation face material 43 may be omitted.

Figure 11:
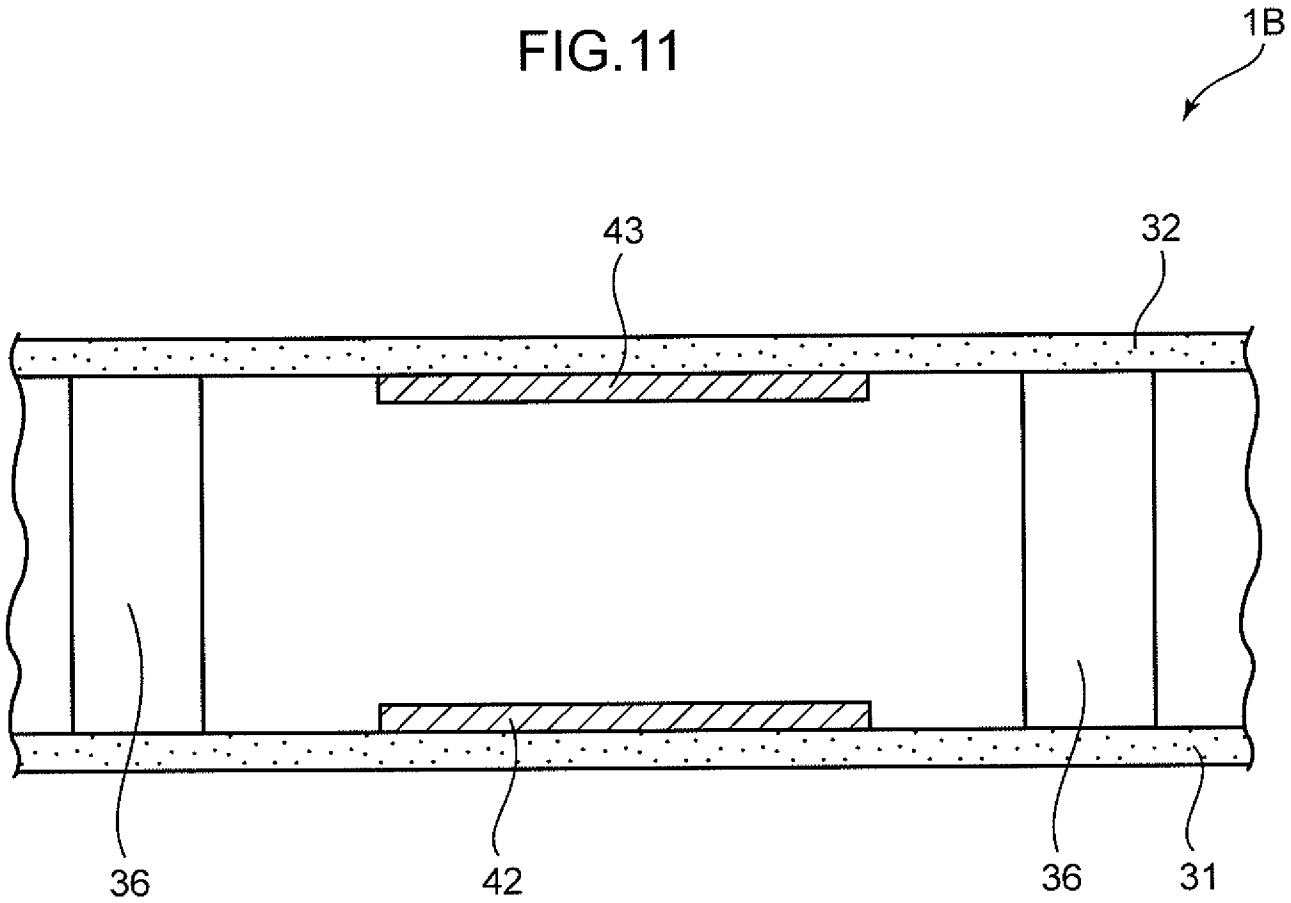
FIG. 11 is a horizontal sectional view schematically illustrating a configuration of a sound insulation structure for a building according to another embodiment of the present invention.

Although the first embodiment has been described with respect to the case where the first vertical materials 34 and the second vertical materials 35 are arranged in a zigzag manner, the present invention is not limited thereto. For example, as in a sound insulation structure for a building 113 illustrated in FIG. 11, the first wall-side sound insulation face material 42 and the second wall-side sound insulation face material 43 may be disposed between two adjacent vertical materials 36, and the first wall-side sound insulation face material 42 and the second wall-side sound insulation face material 43 may be opposed to each other in the wall thickness direction. This modification is also applicable to other embodiments.

Figure 12:
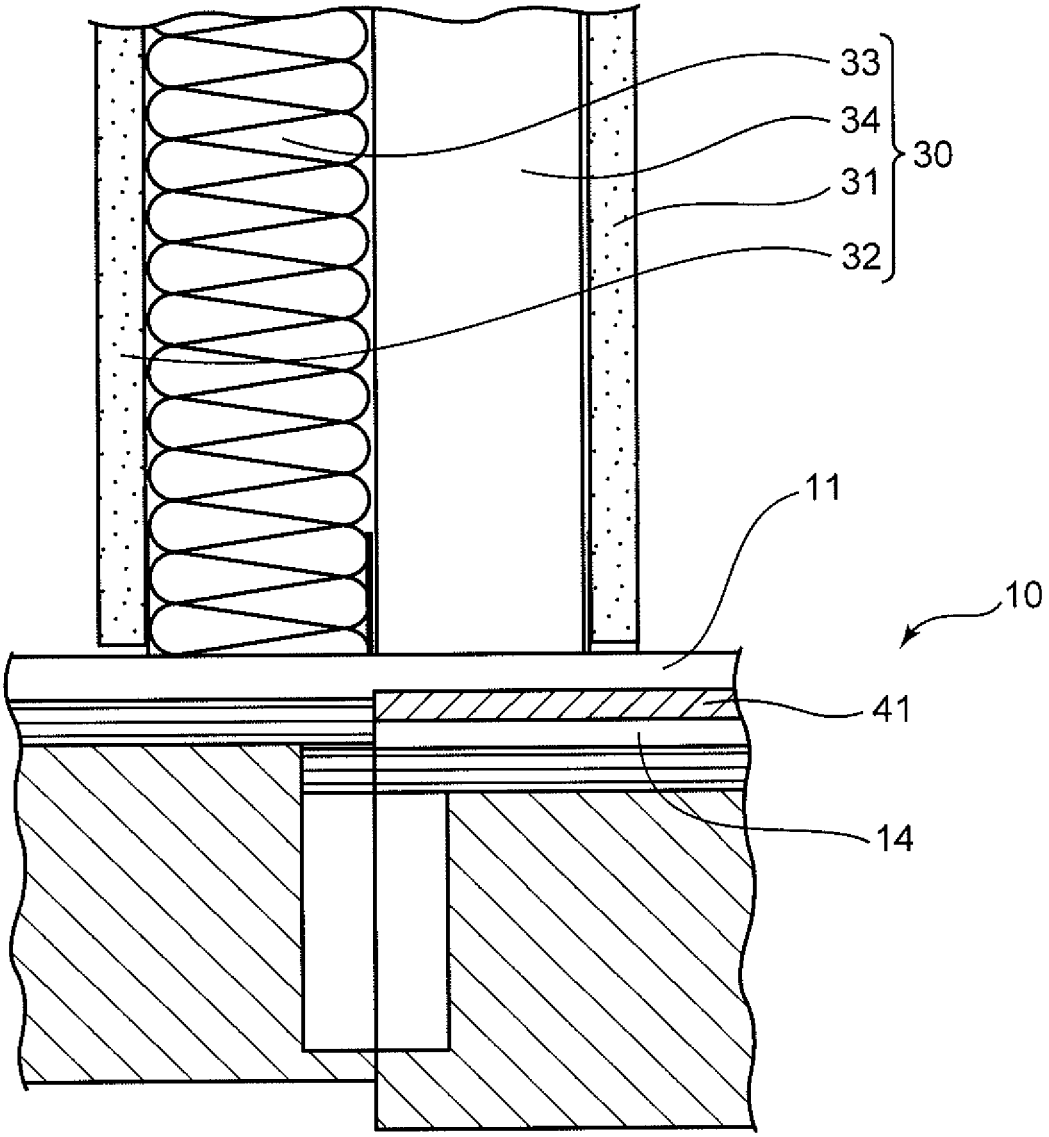
FIG. 12 is a vertical sectional view schematically illustrating a configuration of a sound insulation structure for a building according to still another embodiment of the present invention.

Although the first embodiment has been described with respect to the case where the ceiling-side sound insulation face material 40 is stuck to the ceiling lower surface 21, the ceiling-side sound insulation face material 40 may be stuck to the surface of the ceiling material 20 facing the side opposite to the ceiling lower surface 21. Further, the floor-side sound insulation face material 41 is not exclusively stuck to the floor surface 13, and may be stuck to the floor material 10 in a state of being sandwiched between the flooring 11 and a floor backing material 14, for example, as illustrated in FIG. 12.

In the first embodiment, a thickness of the gypsum plasterboard constituting the floor-side sound insulation face material 41 may be larger than a thickness of the gypsum plasterboard constituting the ceiling-side sound insulation face material 40.

In the sound insulation structures for a building 1 to 3 according to the first to third embodiments, one or both of the first ceiling-side sound insulation face material 45 and the second ceiling-side sound insulation face material 44 described in the fourth embodiment may be combined, or one or both of the first outer wall side sound insulation face material 73 and the second outer wall side sound insulation face material 74 described in the fifth embodiment may be combined.

In the fourth embodiment, a plurality of one or both of the first ceiling-side sound insulation face material 45 and the second ceiling-side sound insulation face material 44 may be overlapped. In this case, in order to prevent the coincidence frequency of the face material from fluctuating, it is preferable to laminate the face materials without bonding to each other.

In the fourth embodiment, one or both of the first ceiling-side sound insulation face material 45 and the second ceiling-side sound insulation face material 44 may be stuck to the ceiling upper surface 22 in the entire space between the adjacent cradlings 50. In addition, one or both of the first ceiling-side sound insulation face material 45 and the second ceiling-side sound insulation face material 44 may be stuck to the ceiling upper surface 22 not only in one space between cradlings but also in other space between the cradlings, and a method of bonding to the ceiling upper surface 22 is not particularly limited and any method enabling sticking to the ceiling upper surface 22 is applicable in addition to the adhesive.

In the fourth embodiment, one or both of the first ceiling-side sound insulation face material 45 and the second ceiling-side sound insulation face material 44 may be stuck to the ceiling lower surface 21.

In the fourth embodiment, the cradling 50 may be disposed so as to have its length direction facing the wall thickness direction of the partition wall 30. In this case, the first ceiling-side sound insulation face material 45 and the second ceiling-side sound insulation face material 44 may be stuck also to a portion of the ceiling upper surface 22 overlapping the hollow portion of the partition wall 30 in the vertical direction. However, in order to secure a wiring space in the space above the ceiling, no face material may be disposed at the portion corresponding to the wiring space.

In the fourth embodiment, it is not particularly limited whether or not the end portions of the first ceiling-side sound insulation face material 45 and the second ceiling-side sound insulation face material 44 are in contact with the one cradling 50 and the cradling 50 adjacent to the one cradling 50.

In the fifth embodiment, one of the first outer wall side sound insulation face material 73 and the second outer wall side sound insulation face material 74 may be omitted.

The above embodiments are summarized as follows.

The sound insulation structure for a building according to the above embodiment includes: a floor material; a ceiling material opposed to the floor material in a vertical direction with a space in a building interposed therebetween; a partition wall extending in the vertical direction and partitioning the space into a first space and a second space adjacent to each other in a horizontal direction; and at least one face material out of a floor-side sound insulation face material stuck to a portion of the floor material in a range of a thickness of the partition wall and having a coincidence frequency different from that of the floor material, and a ceiling-side sound insulation face material stuck to a portion of the ceiling material in the range of the thickness of the partition wall and having a coincidence frequency different from that of the ceiling material.

In the above sound insulation structure for a building, at least one of the floor-side sound insulation face material having the coincidence frequency different from that of the floor material and the ceiling-side sound insulation face material having the coincidence frequency different from that of the ceiling material is stuck to a portion of the floor material or the ceiling material in the range of the thickness of the partition wall. Therefore, when sound generated in one of the first space and the second space partitioned by the partition wall is about to propagate to the other space via the floor material or the ceiling material due to the coincidence effect, the coincidence effect of the portion of the floor material or the ceiling material in the range of the thickness of the partition wall can be suppressed. As a result, sound leakage into an adjacent space via the floor material and the ceiling material is suppressed to improve sound insulation performance.

The above sound insulation structure for a building may include the floor-side sound insulation face material and the ceiling-side sound insulation face material.

According to this configuration, sound leakage into an adjacent space via either of the floor material and the ceiling material can be suppressed.

In the above sound insulation structure for a building, the partition wall may include a first face material extending in the vertical direction; and a second face material extending in the vertical direction and disposed with a hollow portion interposed between the first face material and the second face material in the horizontal direction. The floor-side sound insulation face material may be stuck to the floor material in a range from the first face material to the second face material. The ceiling-side sound insulation face material may be stuck to the ceiling material in a range from the first face material to the second face material.

According to this configuration, the coincidence effect of the floor material and the ceiling material can be suppressed over a wide range, and sound leakage to an adjacent space via the floor material and the ceiling material can be more reliably suppressed.

In the above sound insulation structure for a building, the first face material may have a first inner surface facing a hollow portion side. The second face material may have a second inner surface facing the hollow portion side and opposed to the first inner surface with the hollow portion interposed therebetween. The partition wall may further include a first vertical material extending in the vertical direction and fixed to the first inner surface, and a second vertical material extending in the vertical direction and fixed to the second inner surface. The first vertical material and the second vertical material may be arranged in a zigzag manner along a wall surface direction of the partition wall. The above sound insulation structure for a building may further include at least one face material out of a first wall-side sound insulation face material stuck to a part of the first inner surface so as to overlap the second vertical material in a front view of the first face material and having a coincidence frequency different from that of the first face material, and a second wall-side sound insulation face material stuck to a part of the second inner surface so as to overlap the first vertical material in a front view of the second face material and having a coincidence frequency different from that of the second face material.

According to this configuration, by additionally disposing the face material having the coincidence frequency different from that of the face material of the partition wall, sound leakage to an adjacent space via the partition wall can be suppressed. In addition, since the additional face material is provided on the hollow portion side of the partition wall, it is also possible to suppress an increase in the thickness of the partition wall.

In the above sound insulation structure for a building, the floor-side sound insulation face material may be stuck to a portion of the floor material that is in the range of the thickness of the partition wall and has a predetermined length in a wall surface direction of the partition wall. The ceiling-side sound insulation face material may be stuck to a portion of the ceiling material that is in the range of the thickness of the partition wall and has a predetermined length in a wall surface direction of the partition wall.

According to this configuration, since the coincidence effect of the floor material and the ceiling material can be suppressed over a wider range, sound leakage to an adjacent space via the floor material and the ceiling material can be more reliably suppressed.

In the above sound insulation structure for a building, the partition wall may include: a first face material extending in the vertical direction; a second face material extending in the vertical direction and disposed with a hollow portion interposed between the first face material and the second face material in the horizontal direction; a first vertical material extending in the vertical direction and fixed to a first inner surface of the first face material, the first inner surface facing a hollow portion side; a second vertical material extending in the vertical direction and fixed to a second inner surface of the second face material, the second inner surface facing the hollow portion side; and a positioning member that positions the first vertical material and the second vertical material. The first face material and the second face material may be disposed so as to have an upper end surface abutting on the ceiling material and have a gap formed between a lower end surface and the floor material. The above sound insulation structure for a building may include: at least the floor-side sound insulation face material out of the floor-side sound insulation face material and the ceiling-side sound insulation face material. The floor-side sound insulation face material may be thicker than the gap, disposed on the floor material so as to block the gap from the hollow portion side, and include a portion having a surface density higher than that of the positioning member.

According to this configuration, the gap between the face material of the partition wall and the floor material is blocked by the floor-side sound insulation face material from the hollow portion side of the partition wall, so that sound leakage to an adjacent chamber through the gap can be suppressed. Moreover, since the floor-side sound insulation face material includes the portion having a surface density higher than that of the positioning member, the sound insulation performance can be further improved as compared with a case where the positioning member is directly disposed on the floor material to block the gap.

In the above sound insulation structure for a building, the partition wall may include: a first face material extending in the vertical direction; a second face material extending in the vertical direction and disposed with a hollow portion interposed between the first face material and the second face material in the horizontal direction; a first vertical material extending in the vertical direction and fixed to a first inner surface of the first face material, the first inner surface facing a hollow portion side; a second vertical material extending in the vertical direction and fixed to a second inner surface of the second face material, the second inner surface facing the hollow portion side; and a positioning member that positions the first vertical material and the second vertical material. The first face material and the second face material may be disposed so as to have a lower end surface abutting on the floor material and have a gap formed between an upper end surface and the ceiling material. The above sound insulation structure for a building may include at least the ceiling-side sound insulation face material out of the floor-side sound insulation face material and the ceiling-side sound insulation face material. The ceiling-side sound insulation face material may be thicker than the gap, disposed on the ceiling material so as to block the gap from the hollow portion side, and include a portion having a surface density higher than that of the positioning member.

According to this configuration, by blocking the gap between the face material of the partition wall and the ceiling material from the hollow portion side of the partition wall by the ceiling-side sound insulation face material, sound leakage to an adjacent chamber through the gap can be suppressed. Moreover, since the ceiling-side sound insulation face material includes a portion having a surface density higher than that of the positioning member, the sound insulation performance can be further improved as compared with the case where the positioning member is directly disposed on the ceiling material to block the gap.

The sound insulation structure for a building according to the above embodiment includes: a floor material; a ceiling material opposed to the floor material in a vertical direction with a space in a building interposed therebetween; a partition wall extending in the vertical direction, partitioning the space into a first space and a second space adjacent to each other in a horizontal direction, and having a first outer surface facing a first space side and a second outer surface facing a second space side; and at least one face material out of a first ceiling-side sound insulation face material having a coincidence frequency different from that of the ceiling material and stuck to at least a portion of the ceiling material between a position corresponding to the first outer surface and a position corresponding to a center of the first space in the horizontal direction, and a second ceiling-side sound insulation face material having a coincidence frequency different from that of the ceiling material and stuck to at least a portion of the ceiling material between a position corresponding to the second outer surface and a position corresponding to a center of the second space in the horizontal direction.

In the above sound insulation structure for a building, the face material having the coincidence frequency different from that of the ceiling material is stuck to the portion of the ceiling material between the position corresponding to the outer surface of the partition wall and the position corresponding to the horizontal center of the space. Therefore, when sound generated in one of the first space and the second space partitioned by the partition wall is about to propagate to the other space via the ceiling material due to the coincidence effect, the coincidence effect of the ceiling material can be suppressed. Accordingly, sound leakage to an adjacent space via the ceiling material is suppressed to improve sound insulation performance.

The sound insulation structure for a building according to the above embodiment includes: a floor material; a ceiling material opposed to the floor material in a vertical direction with a space in a building interposed therebetween; a partition wall extending in the vertical direction, partitioning the space into a first space and a second space adjacent to each other in a horizontal direction, and having a first outer surface facing a first space side and a second outer surface facing a second space side; an outer wall extending in a direction intersecting the partition wall; and at least one face material out of a first outer wall side sound insulation face material having a coincidence frequency different from that of the outer wall and stuck to at least a portion of the outer wall between a position corresponding to the first outer surface and a position corresponding to a center of the first space in the horizontal direction, and a second outer wall side sound insulation face material having a coincidence frequency different from that of the outer wall and stuck to at least a portion of the outer wall between a position corresponding to the second outer surface and a position corresponding to a center of the second space in the horizontal direction.

In the above sound insulation structure for a building, the face material having the coincidence frequency different from that of the outer wall is stuck to the portion of the outer wall between the position corresponding to the outer surface of the partition wall and the position corresponding to the horizontal center of the space. Therefore, when sound generated in one of the first space and the second space partitioned by the partition wall is about to propagate to the other space via the outer wall due to the coincidence effect, the coincidence effect of the outer wall can be suppressed. Accordingly, sound leakage to an adjacent space via the outer wall is suppressed to improve sound insulation performance.

In the above sound insulation structure for a building, the partition wall may include: a first face material extending in the vertical direction and having a first inner surface; a second face material extending in the vertical direction, disposed with a hollow portion interposed between the first face material and the second face material in the horizontal direction, and having a second inner surface opposed to the first inner surface with the hollow portion interposed therebetween; a first vertical material extending in the vertical direction and fixed to the first inner surface; and a second vertical material extending in the vertical direction and fixed to the second inner surface. The first vertical material and the second vertical material may be arranged in a zigzag manner along a wall surface direction of the partition wall. The above sound insulation structure for a building may further include at least one face material out of a first wall-side sound insulation face material stuck to a part of the first inner surface so as to overlap the second vertical material in a front view of the first face material and having a coincidence frequency different from that of the first face material, and a second wall-side sound insulation face material stuck to a part of the second inner surface so as to overlap the first vertical material in a front view of the second face material and having a coincidence frequency different from that of the second face material.

According to this configuration, by additionally disposing the face material having the coincidence frequency different from that of the face material of the partition wall, sound leakage to an adjacent space via the partition wall can be suppressed. In addition, since the additional face material is provided on the hollow portion side of the partition wall, it is also possible to suppress an increase in the thickness of the partition wall.

It should be understood that the embodiments disclosed herein are illustrative in all respects and are not restrictive. The scope of the present invention is indicated not by the above description but by the claims, and it is intended that meanings equivalent to the claims and all modifications within the scope are included.

The invention claimed is:

1. A sound insulation structure for a building, comprising:

a floor material;

a ceiling material opposed to the floor material in a vertical direction with a space in a building interposed therebetween, the ceiling material being made of a gypsum plasterboard;

a partition wall extending in the vertical direction and partitioning the space into a first space and a second space adjacent to each other in a horizontal direction; and at least one face material out of a floor-side sound insulation face material stuck to a portion of the floor material in a range of a thickness of the partition wall and having a coincidence frequency different from that of the floor material by 1/12 octave, and a ceiling-side sound insulation face material stuck to a portion of the ceiling material in the range of the thickness of the partition wall, having a coincidence frequency different from that of the ceiling material by 1/12 octave, being made of a gypsum plasterboard, and having a thickness different from that of the ceiling material.

2. The sound insulation structure for a building according to claim 1, comprising the floor-side sound insulation face material and the ceiling-side sound insulation face material.

3. The sound insulation structure for a building according to claim 1, wherein the partition wall includes:

a first face material extending in the vertical direction; and a second face material extending in the vertical direction and disposed with a hollow portion interposed between the first face material and the second face material in the horizontal direction, the floor-side sound insulation face material is stuck to the floor material in a range from the first face material to the second face material, and the ceiling-side sound insulation face material is stuck to the ceiling material in a range from the first face material to the second face material.

4. The sound insulation structure for a building according to claim 3, wherein the first face material has a first inner surface facing a hollow portion side, the second face material has a second inner surface facing the hollow portion side and opposed to the first inner surface with the hollow portion interposed therebetween, and the partition wall further includes a first vertical material extending in the vertical direction and fixed to the first inner surface, and a second vertical material extending in the vertical direction and fixed to the second inner surface, the first vertical material and the second vertical material being arranged in a zigzag manner along a wall surface direction of the partition wall, the sound insulation structure for a building further comprising at least one face material out of a first wall-side sound insulation face material stuck to a part of the first inner surface so as to overlap the second vertical material in a front view of the first face material and having a coincidence frequency different from that of the first face material, and a second wall-side sound insulation face material stuck to a part of the second inner surface so as to overlap the first vertical material in a front view of the second face material and having a coincidence frequency different from that of the second face material.

5. The sound insulation structure for a building according to claim 1, wherein the floor-side sound insulation face material is stuck to a portion of the floor material that is in the range of the thickness of the partition wall and has a predetermined length in a wall surface direction of the partition wall, and the ceiling-side sound insulation face material is stuck to a portion of the ceiling material that is in the range of the thickness of the partition wall and has a predetermined length in a wall surface direction of the partition wall.

6. The sound insulation structure for a building according to claim 1, wherein the partition wall includes:

a first face material extending in the vertical direction;

a second face material extending in the vertical direction and disposed with a hollow portion interposed between the first face material and the second face material in the horizontal direction;

a first vertical material extending in the vertical direction and fixed to a first inner surface of the first face material, the first inner surface facing a hollow portion side;

a second vertical material extending in the vertical direction and fixed to a second inner surface of the second face material, the second inner surface facing the hollow portion side; and a positioning member that positions the first vertical material and the second vertical material, wherein:

the first face material and the second face material being disposed so as to have an upper end surface abutting on the ceiling material and have a gap formed between a lower end surface and the floor material;

the sound insulation structure for a building comprising at least the floor-side sound insulation face material out of the floor-side sound insulation face material and the ceiling-side sound insulation face material, and the floor-side sound insulation face material is thicker than the gap, is disposed on the floor material so as to block the gap from the hollow portion side, and includes a surface facing to the hollow portion and having a surface density higher than that of a surface facing to the hollow portion of the positioning member.

7. The sound insulation structure for a building according to claim 1, wherein the partition wall includes:

a first face material extending in the vertical direction;

a second face material extending in the vertical direction and disposed with a hollow portion interposed between the first face material and the second face material in the horizontal direction;

a first vertical material extending in the vertical direction and fixed to a first inner surface of the first face material, the first inner surface facing a hollow portion side;

a second vertical material extending in the vertical direction and fixed to a second inner surface of the second face material, the second inner surface facing the hollow portion side; and a positioning member that positions the first vertical material and the second vertical material, wherein:

the first face material and the second face material being disposed so as to have a lower end surface abutting on the floor material and have a gap formed between an upper end surface and the ceiling material;

the sound insulation structure for a building comprising at least the ceiling-side sound insulation face material out of the floor-side sound insulation face material and the ceiling-side sound insulation face material, and the ceiling-side sound insulation face material is thicker than the gap, is disposed on the ceiling material so as to block the gap from the hollow portion side, and includes a surface facing to the hollow portion and having a surface density higher than that of a surface facing to the hollow portion of the positioning member.

8. A sound insulation structure for a building, comprising:

a floor material;

a ceiling material opposed to the floor material in a vertical direction with a space in a building interposed therebetween, the ceiling material being made of a gypsum plasterboard;

a partition wall extending in the vertical direction, partitioning the space into a first space and a second space adjacent to each other in a horizontal direction, and having a first outer surface facing a first space side and a second outer surface facing a second space side; and at least one face material out of a first ceiling-side sound insulation face material having a coincidence frequency different from that of the ceiling material, stuck to at least a portion of the ceiling material between a position corresponding to the first outer surface and a position corresponding to a center of the first space in the horizontal direction, being made of a gypsum plasterboard, and having a thickness different from that of the ceiling material and a second ceiling-side sound insulation face material having a coincidence frequency different from that of the ceiling material, stuck to at least a portion of the ceiling material between a position corresponding to the second outer surface and a position corresponding to a center of the second space in the horizontal direction, being made of a gypsum plasterboard, and having a thickness different from that of the ceiling material, wherein:

the sound insulation structure further comprises a first cradling and a second cradling adjacent to the first cradling, the first cradling and the second cradling overlapping the ceiling material in the vertical direction and disposed so as to come into contact with the ceiling material, and the at least one face material is stuck to the ceiling material in a space between the first cradling and the second cradling.

9. The sound insulation structure for a building according to claim 8, wherein the partition wall includes:

a first face material extending in the vertical direction and having a first inner surface;

a second face material extending in the vertical direction, disposed with a hollow portion interposed between the first face material and the second face material in the horizontal direction, and having a second inner surface opposed to the first inner surface with the hollow portion interposed therebetween;

a first vertical material extending in the vertical direction and fixed to the first inner surface; and a second vertical material extending in the vertical direction and fixed to the second inner surface, wherein:

the first vertical material and the second vertical material being arranged in a zigzag manner along a wall surface direction of the partition wall, and the sound insulation structure for a building further comprising at least one face material out of a first wall-side sound insulation face material stuck to a part of the first inner surface so as to overlap the second vertical material in a front view of the first face material and having a coincidence frequency different from that of the first face material, and a second wall-side sound insulation face material stuck to a part of the second inner surface so as to overlap the first vertical material in a front view of the second face material and having a coincidence frequency different from that of the second face material.

10. A sound insulation structure for a building, comprising:

a floor material;

a ceiling material opposed to the floor material in a vertical direction with a space in a building interposed therebetween;

a partition wall extending in the vertical direction, partitioning the space into a first space and a second space adjacent to each other in a horizontal direction, and having a first outer surface facing a first space side and a second outer surface facing a second space side;

an outer wall extending in a direction intersecting the partition wall, the outer wall including an outer wall panel, an outer wall face material disposed with a hollow portion interposed between the outer wall panel and the outer wall face material, and a vertical bar extending in the vertical direction in the hollow portion and being disposed so as to come into contact with a back surface of the outer wall face material facing the hollow portion side;

a first outer wall side sound insulation face material having a coincidence frequency different from that of the outer wall face material and stuck to at least a portion of the outer wall face material between a position corresponding to the first outer surface and a position corresponding to a center of the first space in the horizontal direction, and a second outer wall side sound insulation face material having a coincidence frequency different from that of the outer wall face material and stuck to at least a portion of the outer wall face material between a position corresponding to the second outer surface and a position corresponding to a center of the second space in the horizontal direction, wherein the vertical bar is disposed on the outer wall face material between the first outer wall side sound insulation face material and the second outer wall side sound insulation face material, and the first outer wall side sound insulation face material and the second outer wall side sound insulation face material are stuck to the back surface of the outer wall face material.

* * * * *